United States Patent [19]

Swan

[11] 4,205,775

[45] Jun. 3, 1980

[54] POLYGONAL CONTAINER

[76] Inventor: Walter B. Swan, 7030 W. 100th St., Chicago Ridge, Ill. 60415

[21] Appl. No.: 961,416

[22] Filed: Nov. 16, 1978

[51] Int. Cl.[2] ..... B65D 5/12; B65D 5/64

[52] U.S. Cl. ..... 229/23 R; 229/41 C; 229/38

[58] Field of Search ..... 229/23 BT, 41 C, 45, 229/44, 38, 37 R

[56] References Cited

U.S. PATENT DOCUMENTS

| | | | |
|---|---|---|---|
| 2,285,174 | 6/1942 | Simons | 229/37 |
| 2,772,042 | 11/1956 | Hendrick | 229/41 C |
| 2,925,213 | 2/1960 | Zukoski | 229/41 C |
| 2,950,039 | 8/1960 | Wilson | 229/38 X |
| 3,115,292 | 12/1963 | Repking | 229/23 BT X |
| 3,692,231 | 9/1972 | Neitzke et al. | 229/45 |
| 3,937,392 | 2/1976 | Swisher | 229/41 C |
| 3,966,112 | 6/1976 | Gordon | 229/23 BT |
| 3,977,594 | 8/1976 | Swam | 229/39 R |
| 4,045,117 | 8/1977 | Lerner | 229/41 C X |

FOREIGN PATENT DOCUMENTS

| | | | |
|---|---|---|---|
| 857810 | 4/1940 | France | 229/41 C |

*Primary Examiner*—Davis T. Moorhead
*Attorney, Agent, or Firm*—Robert M. Ward

[57] ABSTRACT

Polygonal containers of the present invention include a container sides assembly and a container bottom assembly which are adapted for interlocking engagement.

The container sides assembly has a plurality of generally rectangular side panels hingedly interconnected to form an enclosure defining the sides of the polygonal container.

A plurality of lower edge flaps are hingedly connected to the lower edge of the rectangular side panels and are adapted for folding upwardly and inside the enclosure to interlockingly receive corresponding elements from the container bottom assembly.

The container bottom assembly has a polygonal bottom panel having sides equal in number to the rectangular side panels and are of such a size to fit snugly within the container sides assembly when in assembled configuration for forming the container bottom.

A plurality of ear members equal in number to the number of sides of the polygonal bottom panel are each hingedly connected to a side of the polygonal bottom panel and are downwardly extending therefrom for operative engagement with the upwardly extending lower edge flaps of the container sides assembly.

A bottom reinforcement element corresponding generally in shape and size to the polygonal bottom panel is disposed in intimate proximity to the polygonal bottom panel to reinforce and strengthen same.

40 Claims, 35 Drawing Figures

FIG. 5
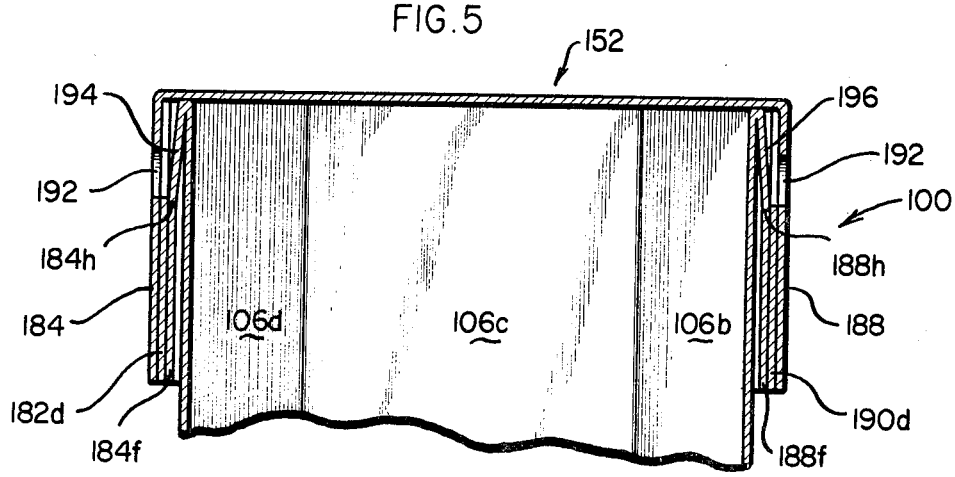
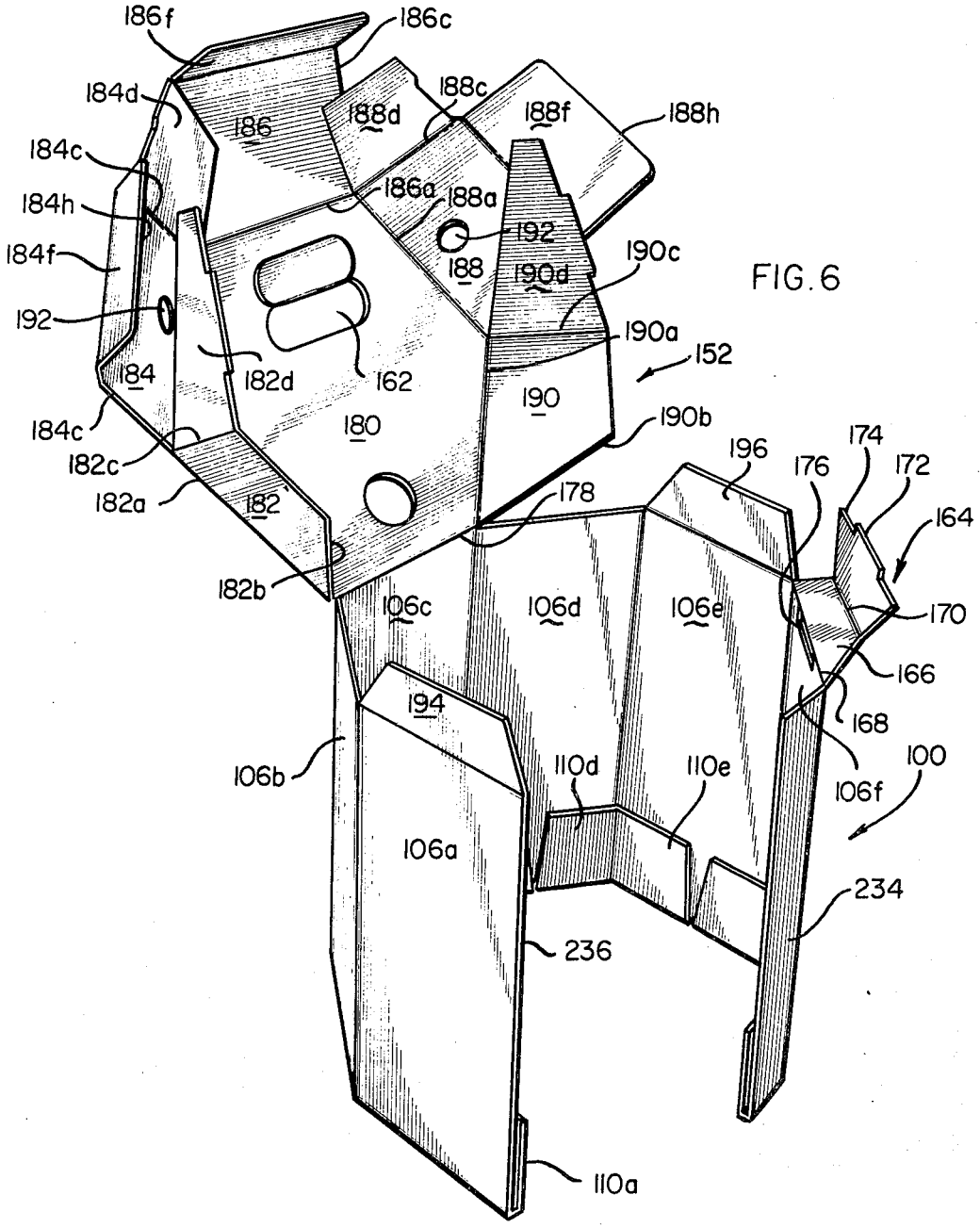
FIG. 6

POLYGONAL CONTAINER

BACKGROUND OF THE INVENTION

The present invention relates generally to polygonal containers and more particularly to polygonal containers having interlocking container sides and bottom assemblies which further include a bottom reinforcement means, whereby the resulting polygonal container is one of exceptional strength and stability.

In the prior art, various polygonal container structures have been proposed for containing various types of goods. A variety of different materials, including paper board, fiber board, and various corrugated materials have been proposed. Although many of such prior art polygonal containers have been generally acceptable for general and/or limited use, typically such prior art polygonal containers have been less than optimal in performance and especially in their weight-supporting capacity. Also, the prior art containers frequently have utilized bottom structures which, rather than representing a point of strength to the container, have resulted in a feature of greatest relative weakness. Moreover, many such prior art containers have resulted in the contained material being supported directly by the ground, thereby frequently resulting in damage to the contents thereof.

In view of the above and other difficulties associated with the prior art, it is an object of the polygonal container of the present invention to provide a container which has increased weight-supporting capacity.

It is also an object of the polygonal container of the present invention to provide a container having a bottom assembly of greatly increased strength.

It is an additional object of the polygonal container of the present invention to provide a container having an interlocking container sides assembly and an interlocking container bottom assembly, which further includes bottom reinforcement means corresponding generally in shape and size to a polygonal bottom panel and disposed into intimate proximity thereto to reinforce and strengthen the bottom panel.

It is a further object of the polygonal container of the present invention to provide bottom reinforcement means which may be foldably formed from a unitary blank of material.

It is yet a further object of the polygonal container of the present invention to provide a polygonal container including stacking means and stacking cavity means to fit the containers substantially snugly together for stability of stacking.

It is a yet further additional object of the polygonal container of the present invention to provide a container top including a handle grip, reinforcement associated therewith for strength thereof during grasping and handling of the polygonal container.

It is also a further object of the polygonal container of the present invention to provide a hingedly connected container lid which may be interlockingly and removably disposed with respect to the container sides assembly.

These and other objects and advantages of the polygonal container of the present invention will become apparent to one of ordinary skill in the art in view of the following specification.

SUMMARY OF THE PRESENT INVENTION

In the polygonal container of the present invention there is provided a container which is polygonal in shape and which has separate container sides and container bottom assemblies adapted for interlocking engagement therebetween. The container sides assembly, in general, preferably comprises a unitary blank of relatively rigid, but foldable, material having a plurality of generally rectangular side panels hingedly interconnected to form an enclosure defining the sides of the polygonal container. The container sides assembly includes a plurality of lower edge flaps hingedly connected to the lower edge of the rectangular side panels and adapted for folding upwardly and inside the enclosure to interlockingly receive corresponding elements of the container bottom assembly.

The container bottom assembly comprises a polygonal bottom panel having sides equal in number to the rectangular side panels of the container sides assembly and is of such a size to fit snugly within the container sides assembly when in assembled configuration thereby forming the container bottom. The container bottom assembly further includes a plurality of ear members equal in number to said number of sides of the polygonal bottom panel. Each ear member is hingedly connected to a side of the polygonal bottom panel and is downwardly extending therefrom for operative engagement with the upwardly extending lower edge flaps of the container sides assembly.

A bottom reinforcement means which corresponds generally in shape and size to the polygonal bottom panel is disposed in intimate proximity to the polygonal bottom panel to reinforce and strengthen the polygonal bottom panel. The bottom reinforcement means may preferably comprise an insert of hard, resilient material, may be formed from a block of styrofoam material, may be formed by a spirally wound strip of material, or may be formed from a unitary blank of corrugated material folded to form the bottom reinforcement means.

The polygonal container of the present invention may further include any of several lid assemblies therefor. One such preferred lid assembly is hingedly connected to one of the rectangular side panels at a top edge thereof. This preferred lid assembly comprises a polygonal top panel of the size and shape generally corresponding to the opening at the top of the enclosure formed by the polygonal container. A plurality of side panels extend downwardly from the polygonal top panel to form interlocking sides of the lid assembly such that the container is securely capped at each polygonal side of the container opening. The container lid assembly further preferably includes a lid securement means for releaseably interlocking the lid assembly with the container sides assembly.

BRIEF DESCRIPTION OF THE DRAWING

FIG. 5 is a sectional view taken along line 5—5 of FIG. 1 further showing the details of the means provided for removably securing the attached unitary lid assembly;

FIG. 6 is a perspective view of the polygonal container embodiment as shown in FIG. 1 in partially assembled configuration;

DETAILED DESCRIPTION OF PREFERRED EMBODIMENTS

Figure 1:
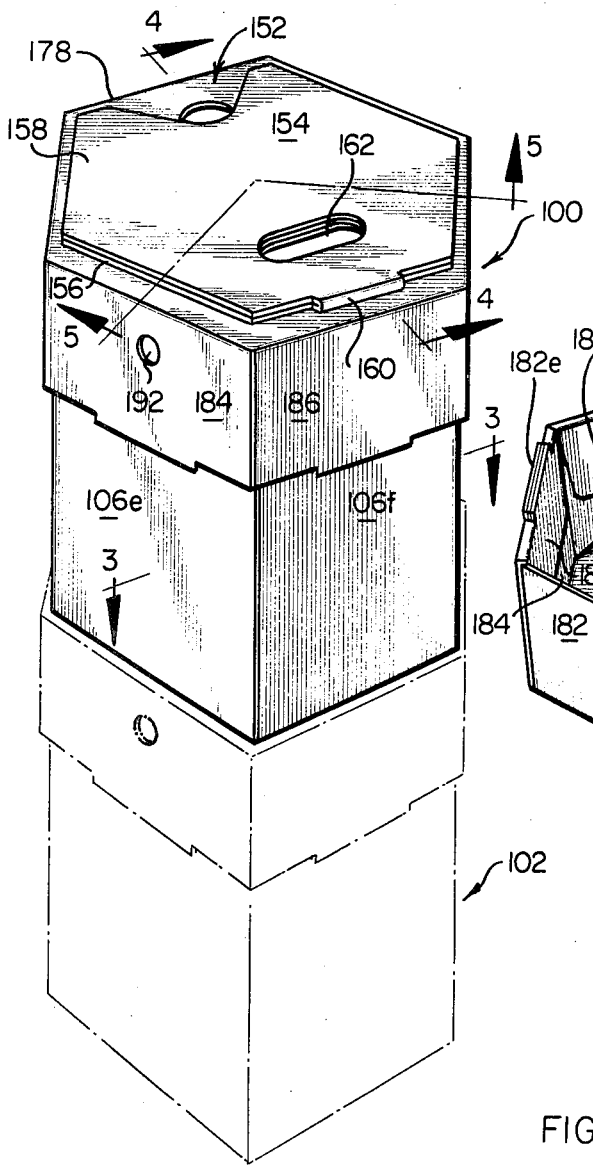
FIG. 1 is a top perspective view of a preferred embodiment of the polygonal container of the present invention illustrating the stackable feature thereof.

Polygonal containers in accordance with the principles and teachings of the present invention include a container sides assembly and a container bottom assembly which is adapted for interlocking engagement with the container sides assembly at the lower portion thereof to form the container bottom. The container sides assembly comprises a plurality of generally rectangular side panels interconnected to form an enclosure defining the sides of the polygonal container. A plurality of preferably slotted lower edge flaps are hingedly connected to the lower edge of the rectangular side panels and are adapted for folding upwardly and inside the enclosure to interlockingly receive corresponding elements from the container bottom assembly.

The container bottom assembly includes a polygonal bottom panel having sides equal in number to those of the rectangular side panels and is of such a size as to snugly fit within the container sides assembly when it is in assembled configuration, thereby to form the container bottom. A plurality of ear members equal in number to the number of sides of the polygonal bottom panel are each hingedly connected to a side of the polygonal bottom panel and extend downwardly therefrom for operative engagement with the upwardly extending lower edge flaps of the container sides assembly. A bottom reinforcement means for the container bottom is provided to correspond generally to the size and shape of the polygonal bottom panel and to be disposed into intimate proximity to the polygonal bottom panel to reinforce and strengthen the polygonal bottom panel. Such bottom reinforcement means preferably is disposed in contact with and is fixedly secured to the polygonal bottom panel at the underside thereof. Means for fixably securing the bottom reinforcement means may includes staples, glue, or other means known to one skilled in the art. The bottom reinforcement means may also be maintained in intimate proximity to the polygonal bottom panel by means of an interference fit between the bottom reinforcement means and the plurality of lower edge flaps when the lower edge flaps are folded upwardly and inside the container enclosure to interlockingly receive the ear members of the container bottom assembly.

The bottom reinforcement means may preferably comprise an insert of a hard, resilient material, such as metal, plastic, fiberboard, or other materials. An insert of styrofoam material may also be utilized. An alternative preferred bottom reinforcement means may comprise an insert of a vertically corrugated material having a multiplicity of corrugated ribs extending normal to the polygonal bottom panel such as in a vertical honeycomb configuration. The multiplicity of corrugated ribs covers substantially one face of the polygonal bottom panel to support and reinforce the entirety thereof and especially against a downwardly compressive force.

Further alternative bottom reinforcement means may comprise a preferably unitary blank having a polygonal central bottom reinforcement panel corresponding generally to the size and shape of the polygonal bottom panel. A plurality of supplemental reinforcement panels equal in number to the number of polygonal sides of the polygonal central bottom reinforcement panel may be attached thereto by means of hinges disposed therebetween, thereby permitting reflexively folding a first supplemental bottom reinforcement panel and the others in sequence to form a multi-layered insert having a substantial thickness. The length of the hinge means between the respective supplemental bottom reinforcement panels and the polygonal central reinforcement panel preferably increases proportionally from the first supplemental bottom panel to the last supplemental reinforcement bottom panel, whereby the multi-layered insert once folded will tend to remain in such multi-layered configuration without the application of substantial external force. The polygonal bottom reinforcement panel, the supplemental bottom reinforcement panel, and the hinge means may preferably comprise a horizontally corrugated material having corrugated ribs disposed generally parallel to each other uniformly along the length of the unitary panel. The result of such a structure is that when the supplemental bottom panels are reflexively folded to form the multi-layered insert configuration, the corrugated ribs on adjacent supplemental bottom panels overlap each other at an acute angle to form a structure having substantially uniform flex resistance to bending in any lateral direction. This preferred embodiment of a bottom reinforcement insert preferably has sides of less than seven (7) in number with the hexagonal shape being preferred.

A further alternative embodiment of a bottom reinforcement means includes a plurality of hingedly interconnected supplemental bottom support panels of substantially the same size and shape as the polygonal bottom panel, at least one of which supplemental bottom support panels is hingedly connected to the bottom support panel at a polygonal side thereof for reflexively folding onto the bottom support panel, thereby to provide reinforcement thereto. The supplemental bottom support panels are reflexively folded on the underside of the polygonal bottom container in preferred embodiments. At least one such supplemental bottom support panel is hingedly connected to each of a pair of opposing polygonal sides of the polygonal bottom support panel. Such opposing connected supplemental bottom support panels are preferably hingedly connected to the polygonal side of the polygonal bottom panel near the juncture of the connected polygonal side with the adjacent polygonal side of the polygonal bottom panel. In such embodiments, the ear members of the container bottom assembly are connected to such polygonal bottom panel interior of the connection thereof with the supplemental bottom support panel. Also in such preferred embodiments, at least a first supplemental bottom support panel is foldable along a fold line dividing such first supplemental bottom support panel into equal parts for reflexively folding at least such first supplemental bottom support panel onto itself, whereby the container bottom is disposed into folded configuration. In such a configuration each such opposing first supplemental bottom support panel reinforces one-half of the polygonal bottom panel. A second supplemental bottom support panel having such fold lines thereon is preferably provided for hinged connection to the oppositely disposed first supplemental bottom support panel for additional reinforcement to the polygonal bottom panel.

In other alternative preferred embodiments, the reinforcement means may comprise a strip of flexible material which is spirally wound to form a cylindrical body having a diameter of such size and shape as to fit snugly with respect to the lower edge flaps of the container sides assembly when the container sides assembly is disposed in interlocking engagement with the container bottom assembly. Such polygonal containers may have from twelve (12) to twenty-four (24) sides, although a lesser number of sides, such as the hexagonal shape, is meant to be included within the scope of the present invention.

The polygonal container of the present invention may further include a stacking cavity at the bottom thereof bounded by the bottom reinforcement means lower surface and the lower edge flaps. Corresponding means for covering the opening at the top of the polygonal container of the enclosure may include thereon a mating stacking means projecting above the surface thereof for engagement with the stacking cavity of another polygonal container. The stacking means and stacking cavity are preferably of such corresponding size and shape to fit substantially snugly together, whereby stable stacking of containers may be maintained. One preferred embodiment for such stacking means includes at least two polygonal stacking panels hingedly connected at polygonal sides thereof for reflexively folding together into intimate contact of the respective faces thereof to form a stacking block of substantial thickness for stacking engagement with the stacking cavity. Alternatively, a solid block of material, such as styrofoam, may be utilized.

A polygonal container of the present invention may further include, in conjunction with a lid assembly having an aperture therein, a handle grip reinforcement means for use when the container is manually grasped and handled. Such handle grip reinforcement means preferably comprises a grip member which is hingedly connected at the proximal portion thereof to the top edge of the rectangular side panel forming the proximate polygonal side and projecting laterally across the opening to a position adjacent the lid aperture. Such handle grip reinforcement grip member is preferably reflexively foldable at a central portion thereof and has a mating tab for interlocking engagement with a horizontal slot means contained in the corresponding rectangular side panel top portion.

The polygonal container of the present invention may also include a lid assembly hingedly connected to one of the rectangular side panels at the top edge thereof. The lid assembly preferably comprises a polygonal top panel of sufficient size and shape to cover the opening at the top of the enclosure formed by the polygonal container. The top panel is hingedly connected at a first lid polygonal side thereof to the top edge of one of the rectangular side panels to form a first, hinged polygonal lid side. A plurality of lid side panels, being one less in number than the number of polygonal sides of the polygonal container, are each hingedly connected at a proximal portion thereof to a polygonal side of the polygonal top panel. Each lid side panel is disposable downwardly when in assembled configuration into contacting relationship with the top portion of the corresponding rectangular top panels of the container sides assembly to close the opening at the top of the enclosure formed by the polygonal container. A pair of the lid side panels are connected to second and third lid polygonal sides adjacent to the first, hinged polygonal lid side. Each of the second and third lid polygonal sides has a free side edge and abutting side edges. The remainder of the lid side panels have two opposed abutting side edges when the lid side panels are disposed downwardly in an assembled configuration.

A plurality of interlocking panels, being two less in number than the number of polygonal sides of the polygonal container, are each hingedly connected to an opposed side edge of a corresponding lid side panel. Each side panel bears a locking protrusion thereon. Each of a plurality of securement panels, being three less than the number of sides of the polygonal container, is hingedly connected at its proximal end to the distal end of one of the remainder of the lid side panels. Each such securement panel has a locking slit disposed at the hinged connection with the corresponding lid side panel for mating engagement with such locking protrusion, thereby to secure the lid in assembled configuration.

The unitary lid and container sides assembly preferably further includes lid securement means for removably securing the assembled lid atop the assembled container sides assembly. The lid securement means preferably comprises a securement release access aperture disposed in at least one of the remainder of the lid side panels to form an apertured lid side panel. A lid securement flap is hingedly disposed at the top edge of the rectangular side panel corresponding to each of the apertured lid side panels. Each of the lid securement flaps is foldable outwardly and downwardly for locking engagement with the corresponding securement panel distal edge. The result of such structure is that, when the lid assembly is in assembled configuration, it may be disposed over the top portion of the container sides assembly to slide over and lockingly engage the lid securement flap. Thereafter, the lid securement flaps may be manually pressed and disposed slightly inwardly through the securement release access aperture to disengage the lid securement flaps from the securement panel distal edge for removing the cover.

The polygonal container of the present invention may have a polygonal lid provided for use in connection therewith. The polygonal lid includes a polygonal top panel having a number of polygonal sides the same in number as the number of sides of the corresponding polygonal container. The polygonal top panel is of such size and shape to correspond substantially to the size and shape of the opening of the top of the polygonal container. A plurality of lid side panels are provided, being the same in number as the number of sides of the polygonal container, each having oppositely disposed upper and lower edges and opposed side edges. Each lid side panel is hingedly connected at a proximal edge thereof to a polygonal side of the polygonal top panel for foldable disposition downwardly and substantially normal to the polygonal top panel to dispose adjacent lid side panels in substantially contacting relationship at the opposed sides thereof.

Also included are means for maintaining the opposed sides in substantially contacted relationship. A securement panel is hingedly connected to the distal edge of each lid side panel with the securement panel being reflexively foldable upwardly to dispose each securement panel into intimate proximity to the interior surface of each of the lid side panels. Further included are lid securement means for removably securing the polygonal top on the assembled container. The lid securement means includes a securement release access aperture disposed on at least one of the lid side panels to form an apertured lid side panel. A lid securement flap is hingedly disposed at the top edge of the rectangular side panel corresponding to each of the apertures of the side panels. Each lid securement panel is foldable outwardly and downwardly for locking engagement with the corresponding securement panel distal edge. The result is that when in assembled configuration the lid assembly may be disposed over the top portion of the container sides assembly to slide over and lockingly engage the lid securement flap.

The polygonal container of the present invention may preferably have lower edge flaps and corresponding engaging ear members which are equal in number. The number of sides of the polygonal container may be three or greater, preferably six in some embodiments and twelve to twenty-four in others. The lower edge flaps of the container sides assembly are preferably separated from each other by a slit extending from the lower extremity of the container sides assembly to the corresponding rectangular side panel, thereby to render the lower edge flaps more easily foldable upwardly in engagement with the ear members of the container bottom assembly. Such slits separating the lower edge flaps may perferably extend from the lower extremity of the container to a point preferably disposed between two adjacent rectangular side panels to permit greater ease in folding the lower edge flaps upwardly.

The container sides assembly may further preferably include a longitudinally extending side flap hingedly disposed therefrom, with the panel disposed at the opposite side of the blank having a free edge for receiving the longitudinally extending side flap, thereby to form the enclosure of the polygonal container.

The polygonal container of the present invention may also include in preferred embodiments a cap assembly for covering the opening at the top of the enclosure formed by the polygonal container. The cap assembly preferably includes at least one polygonal cover panel hingedly attached at a first polygonal side thereof to the top edge of a first rectangular side panel. The polygonal cover panel is foldable generally normal to the first rectangular side panel for covering the top opening of the polygonal container. A polygonal cover hinge is foldably attached to the polygonal cover panel at a second polygonal side which is adjacent to the first polygonal side. The polygonal cover hinge is also foldably attached at the top edge of a second rectangular side panel which is adjacent to the first rectangular side panel. The polygonal cover hinge is wedge-shaped to span the angle between the second polygonal side of the polygonal cover panel and between the top edge of the second rectangular side panel, the angle being generally bisected by a fold line thereby forming the hinged structure. The functioning of that structure is such that, when the polygonal cover panel is disposed normal to the first rectangular side panel, the second polygonal side of the polygonal cover panel is disposed onto the top edged of the second rectangular side panel to cover the opening at the top of the enclosure formed by the polygonal container. In an alternative preferred embodiment, at least two polygonal cover panels and accompanying polygonal cover hinges may be provided for overlapping disposition when in the folded position normal to the correspondingly rectangular side panels. The polygonal cover panels may be separated by two intervening rectangular side panels. Supplemental cover panels of lesser size than the polygonal cover panels may be provided for supplemental support to the polygonal cover panels when in such folded and covering relationship.

Figure 2:
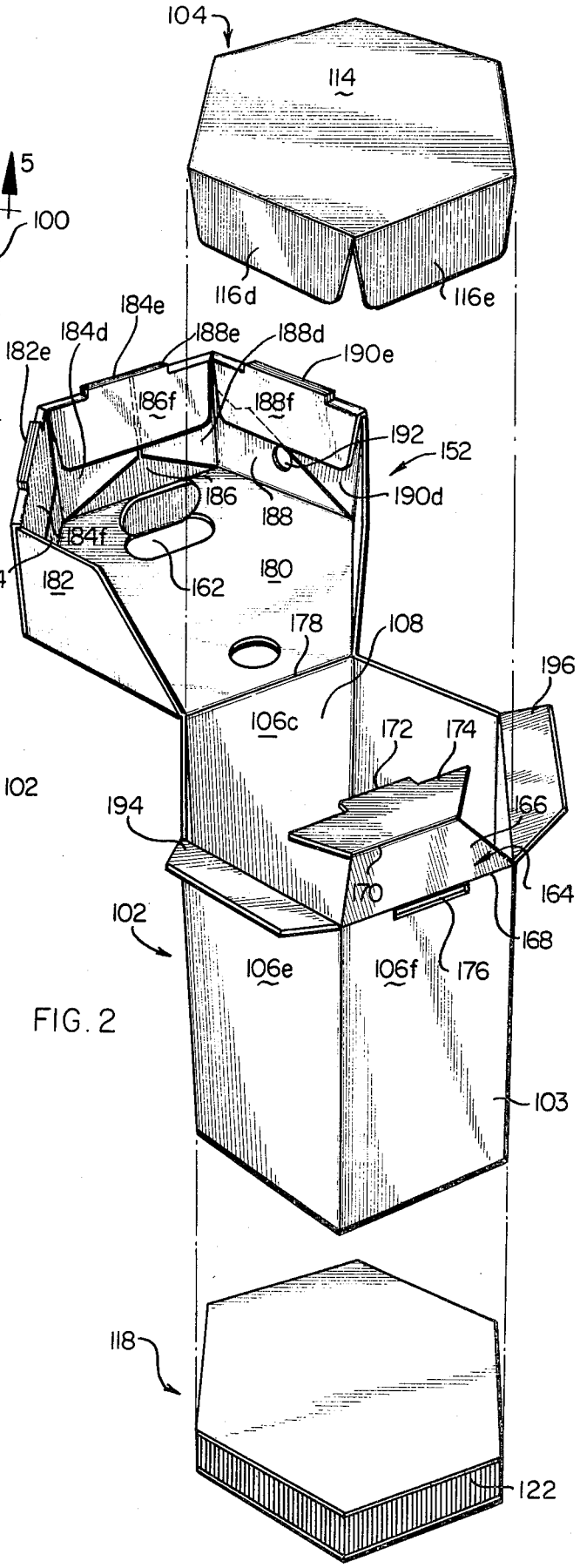
FIG. 2 is an exploded perspective view of the embodiment of FIG. 1 showing the details of the container sides assembly, attached lid assembly, and handle grip reinforcement means, and also showing the container bottom assembly for insertion into a container sides assembly for interlocking disposition therewith, and further showing a bottom reinforcement insert.
Figure 3:
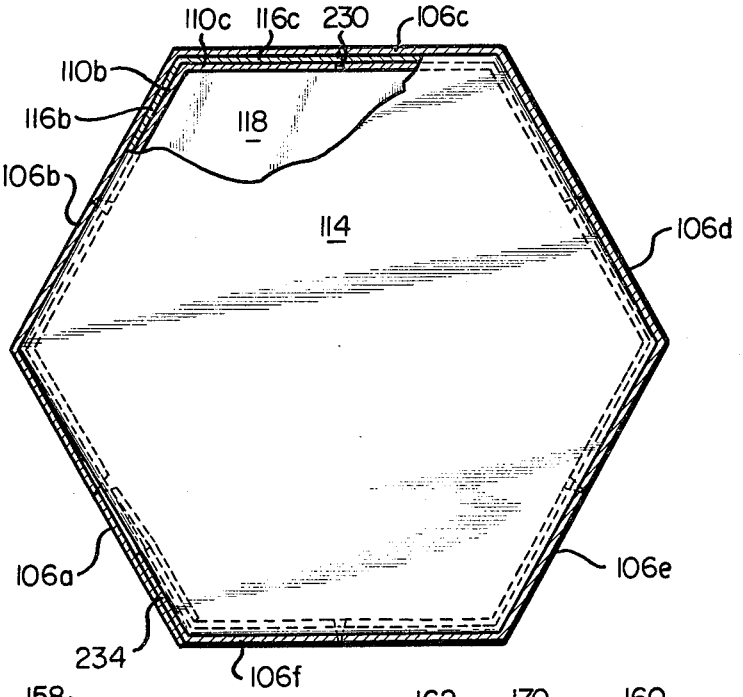
FIG. 3 is a sectional view taken along line 3—3 of FIG. 1 showing the details of interlocking mechanism between the lower edge flaps of the container sides assembly and the ear members of the container bottom assembly.
Figure 4:
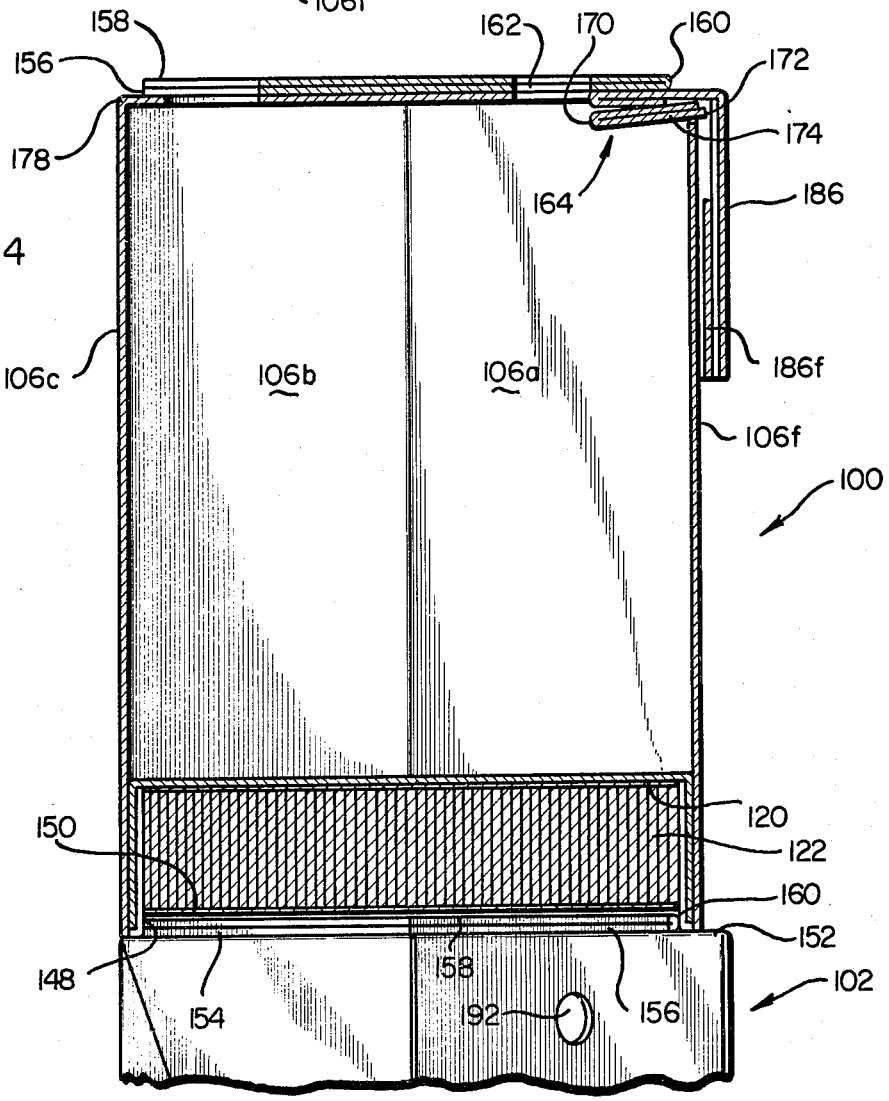
FIG. 4 is a sectional view taken along line 4—4 of FIG. 1 showing the interlocking feature between the container sides assembly and the container bottom assembly, also showing the means provided for stacking several such polygonal containers, and further showing means for removably securing the attached unitary lid assembly.
Figure 8:
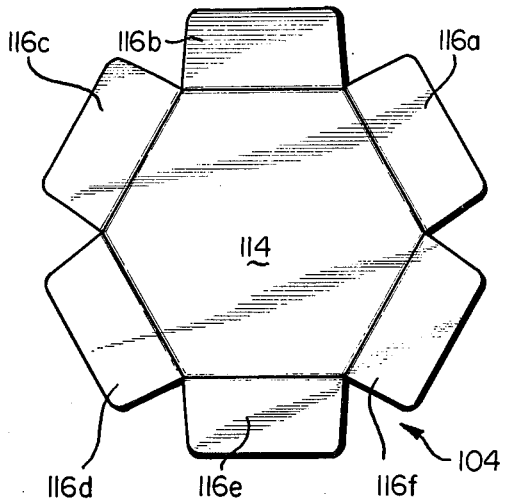
FIG. 8 is a plan view of the container bottom panel and hingedly attached ear members thereof.

Referring now to the drawing wherein common members are for the most part utilized for common elements and to FIGS. 1 and 2 in particular, the polygonal container of the present invention shown generally at 100 includes a container sides assembly generally 102 and a container bottom assembly generally 104 which is adapted for interlocking engagement with container sides assembly 102 at the lower portion 103 thereof to form the container bottom. Container sides assembly 102 comprises a plurality of generally rectangular side panels 106*a–f* (see FIGS. 9 and 12) interconnected to form an enclosure 108 defining the sides of polygonal container 100. A plurality of preferably slotted, lower edge flaps 110*a–f* are hingedly connected to the lower edge 112 of rectangular side panels 106*a–c* and are adapted for folding upwardly and inside enclosure 108 to interlockingly receive corresponding elements from container bottom assembly 104. Container bottom assembly 104 includes a polygonal bottom panel 114 having sides equal in number to those of the rectangular side panels 106*a–f* and is of such a size as to snugly fit within the container sides assembly 102 when it is in assembled configuration, thereby to form the container bottom. As shown in FIG. 8, a plurality of ear members 116*a–f* equal in number to the number of sides of polygonal bottom panel 114 are each hingedly connected to a side of polygonal bottom panel 114 and extend downwardly therefrom for operative engagement with the upwardly extending lower edge flaps 110*a–f* of container sides assembly 102. A bottom reinforcement means generally 118 for the container bottom is provided to correspond generally to the size and shape of polygonal bottom panel 114 and to be disposed into intimate proximity to polygonal bottom panel 114 to reinforce and strengthen polygonal bottom panel 114. Such bottom reinforcement means 118 preferably is disposed in contact with and is fixably secured to polygonal bottom panel 114 at the underside 120 thereof as shown in FIG. 4. Means for fixably securing the bottom reinforcement means may include staples, glue or other means known to one skilled in the art. Bottom reinforcement means 118 may also be maintained in intimate proximity to polygonal bottom panel 114 by means of an interference fit between bottom reinforcement means 118 and the plurality of lower edge flaps 110*a–f* where lower edge flaps 110*a–f* are folded upwardly and inside the container enclosure as shown in FIGS. 4 and 6 to interlockingly receive ear members 116*a–f* of container bottom assembly 104.

Figure 11:
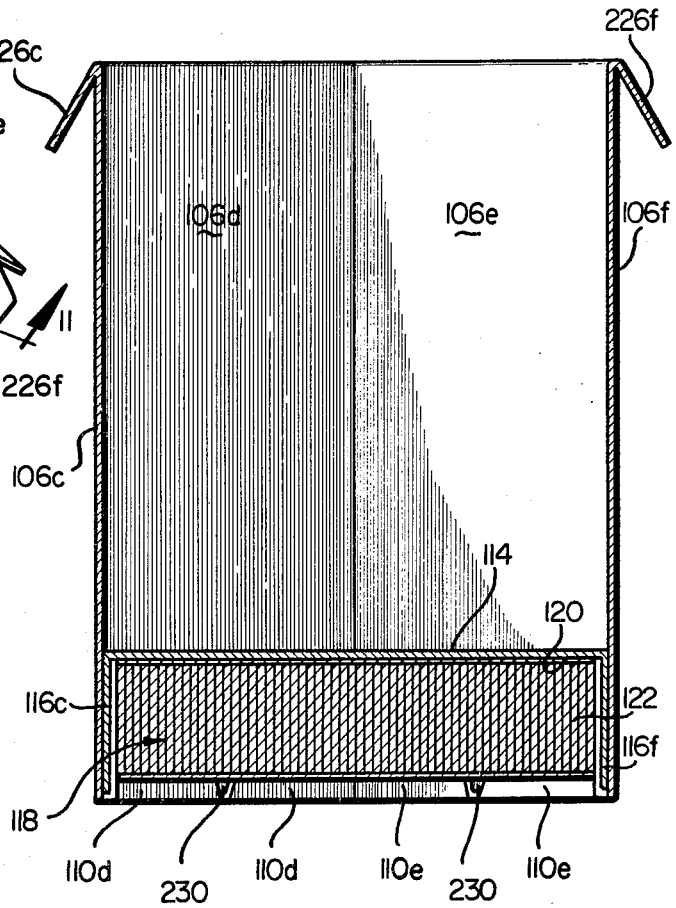
FIG. 11 is a sectional view taken along line 11—11 of FIG. 10 showing the alternative preferred embodiment of the present invention as depicted in FIG. 10, further showing the interlocking relationship between the container sides assembly and the container bottom assembly, and yet further showing the bottom reinforcement means thereof.

Bottom reinforcement means 104 may preferably comprise an insert of a hard, resilient material, such as metal, plastic, fiberboard, or other material. An insert of styrofoam material may also be utilized. As shown in FIGS. 2, 4, and 11, an alternative preferred bottom reinforcement means 118 may comprise an insert of a vertically corrugated material having a multiplicity of corrugated ribs 122 extending normal to polygonal bottom panel 114 such as in a vertical honeycomb configuration. The multiplicity of corrugated ribs 122 covers substantially one face of polygonal bottom panel 114 to support and reinforce the entirety thereof and especially against a downwardly compressive force.

Figure 17:
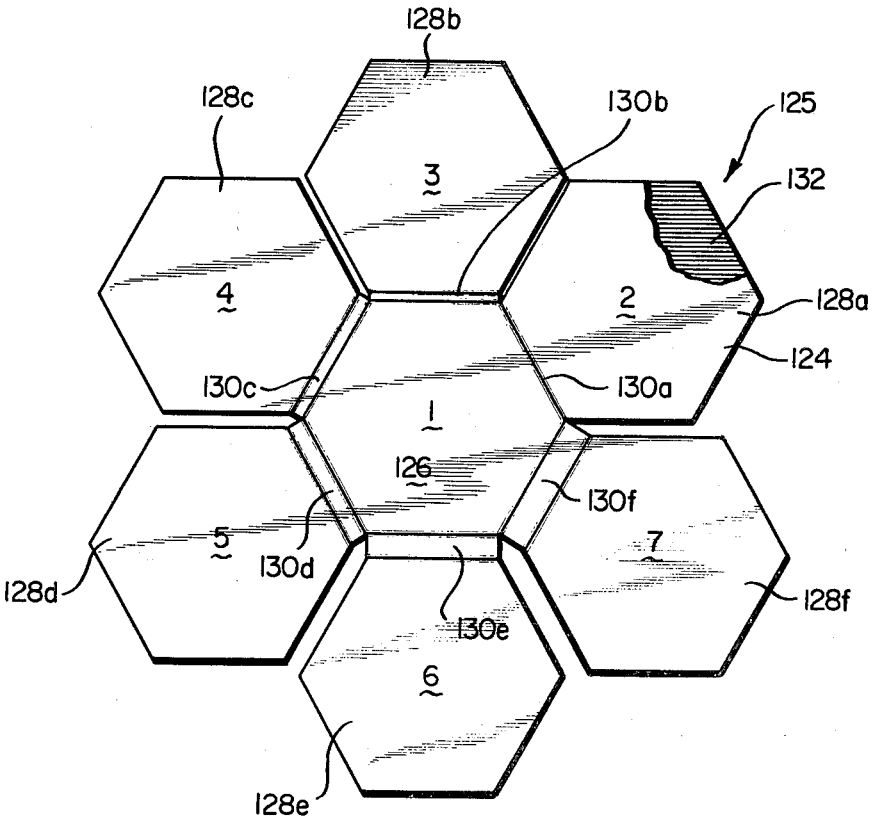
FIG. 17 is a plan view of a unitary blank for forming the bottom reinforcement insert as shown in FIG. 15 showing the order of reflexive folding of the supplemental bottom reinforcement panels.
Figure 18:
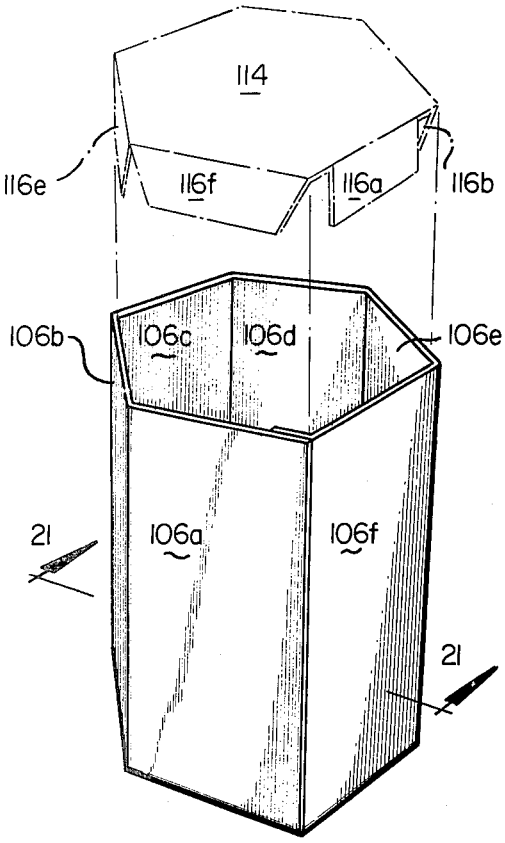
FIG. 18 is an exploded top perspective view of a further preferred embodiment of a bottom reinforcement insert being insertable into a container sides assembly.

As shown in FIGS. 13–17, further alternative bottom reinforcement means 125 may comprise a preferably unitary blank 124 as shown in FIG. 17 having a polygonal central bottom reinforcement panel 126 corresponding generally to the size and shape of the polygonal bottom panel 114. A plurality of supplemental reinforcement panels 128*a–f* equal in number to the number of polygonal sides of the polygonal central bottom reinforcement panel 126 may be attached thereto by means of hinges 130*a–f* disposed therebetween (see FIG. 17) thereby permitting reflexively folding a first supplemental bottom reinforcement panel 130*a* and the others 130*b–f* in sequence to form a multi-layered insert 131 having a substantial thickness. The length of hinge means 130*a–f* between the respective supplemental bottom reinforcement panels 128*a–f* and polygonal central reinforcement panel 126 preferably increases proportionally from first supplemental bottom panel 128*a* to the last supplemental reinforcement bottom panel 128*f*, whereby the multi-layered insert 125 once folded will tend to remain in such multi-layered configuration without the application of substantial external force. Polygonal bottom reinforcement panel 126, supplemental bottom reinforcement panel 128*a–f* and hinge means 130*a–f* may preferably comprise a horizontally corrugated material having corrugated ribs 132 disposed generally parallel to each other uniformly along the length of unitary panel 218. The result of such a structure is that when the supplemental bottom panels 128*a–f* are reflexively folded in such numbered sequence to form multi-layered insert 131, corrugated ribs 132 on adjacent supplemental bottom panels overlap each other at an acute angle to form a structure having substantially uniform flex resistance to bending in any lateral direction, as illustrated by grain direction lines 1-3-6, and 2–5 of FIG. 16. This preferred embodiment of a bottom reinforcement insert 125 preferably has sides of less than seven (7) in number with the hexagonal shape being preferred as illustrated in FIGS. 13–17.

Figure 19:
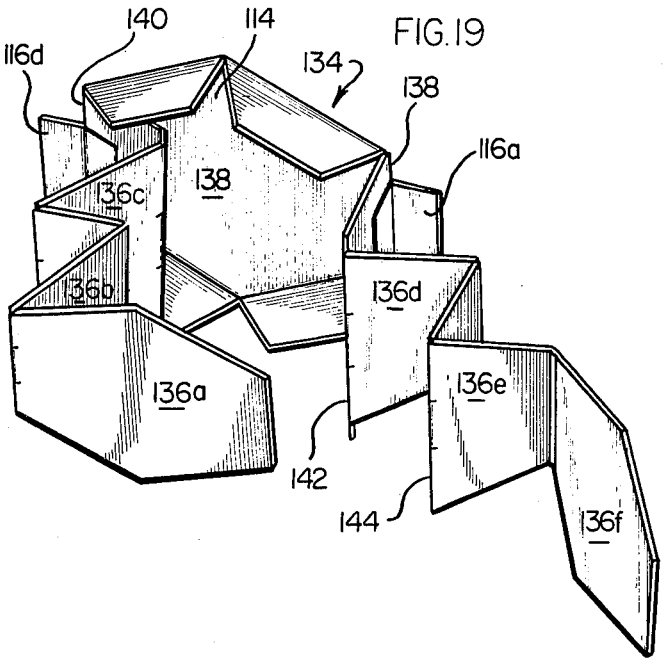
FIG. 19 is a partially assembled bottom perspective view of the bottom reinforcement insert shown in FIG. 18.
Figure 20:
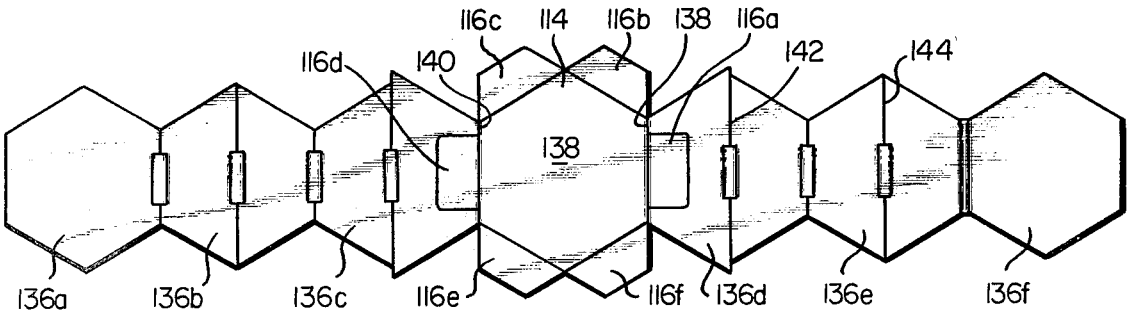
FIG. 20 is a plan view of a unitary blank for forming the bottom reinforcement insert shown in FIG. 18, showing a plurality of supplemental bottom support panels hingedly connected to the bottom container assembly for reflexively folding thereon to form a multi-layered, unitary container bottom assembly and bottom reinforcement means.
Figure 21:
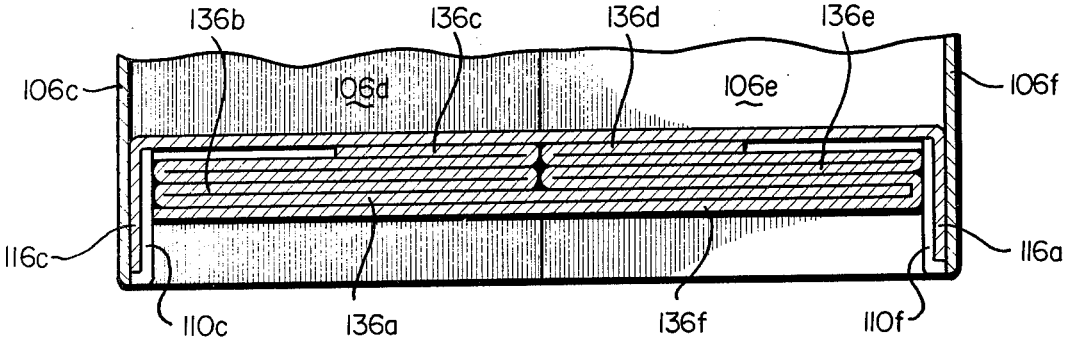
FIG. 21 is a fragmented view taken along line 21—21 of FIG. 18 showing the further preferred embodiment of the unitary container bottom assembly and bottom reinforcement insert shown in FIG. 18 in its assembled configuration in operative engagement with the container sides assembly.

A further laternative embodiment of a bottom reinforcement means 134 is shown in FIGS. 18–21 and includes a plurality of hingedly interconnected supplemental bottom support panels 136*a–f* of substantially the same size and shape as polygonal bottom panel 114, at least one of which supplemental bottom support panels (136*d*, for example) is hingedly connected directly to bottom support panel 114 at a polygonal side 138 thereof for reflexively folding onto the bottom support panel 114 as shown in FIG. 19, thereby to provide reinforcement thereto. Supplemental bottom support panels 136*a–f* are reflexively folded on the underside 138 of polygonal bottom container 114 in preferred embodiments. At least one such supplemental bottom support panel (136*c* and 136*d*, for example) is hingedly connected to each of a pair 138, 140 of opposing polygonal sides of polygonal bottom support panel 114. Such opposing connected supplemental bottom support panels 136*c* and 136*d* are preferably hingedly connected to polygonal sides 138, 140 of polygonal bottom panel 114 near the juncture of the connected polygonal side with the adjacent polygonal side of polygonal bottom panel. In such embodiments, ear members 116*a*, 116*d* of container bottom assembly 104 are connected to such polygonal bottom panel 114 interior of the connection thereof with supplemental bottom support panels 136*d* and 136*c* respectively . Also in such preferred embodiments, at least a first supplemental bottom support panel 136*d* is foldable along a fold line 142 dividing such first supplemental bottom support panel 136*d* into equal parts for reflexively folding at least such first supplemental bottom support panel 136*d* onto itself, whereby the container bottom is disposed into folded configuration to form an insert of substantial thickness as shown in FIG. 21. In such a configuration each such opposing first supplemental bottom support panel 136*c* and 136*d* reinforces one-half of the polygonal bottom panel 114. A second supplemental bottom support panel 136*e* having such fold line 144 thereon is preferably provided for hinged connection to first supplemental bottom support panel 136*d* for additional reinforcement to the polygonal bottom panel 114. In further preferred embodiments a third, unfolded supplemental bottom support panel 136*f* may be attached to second supplemental bottom panel 136*e* opposite the first supplemental bottom support panel 136*d* for yet further support.

Figure 30:
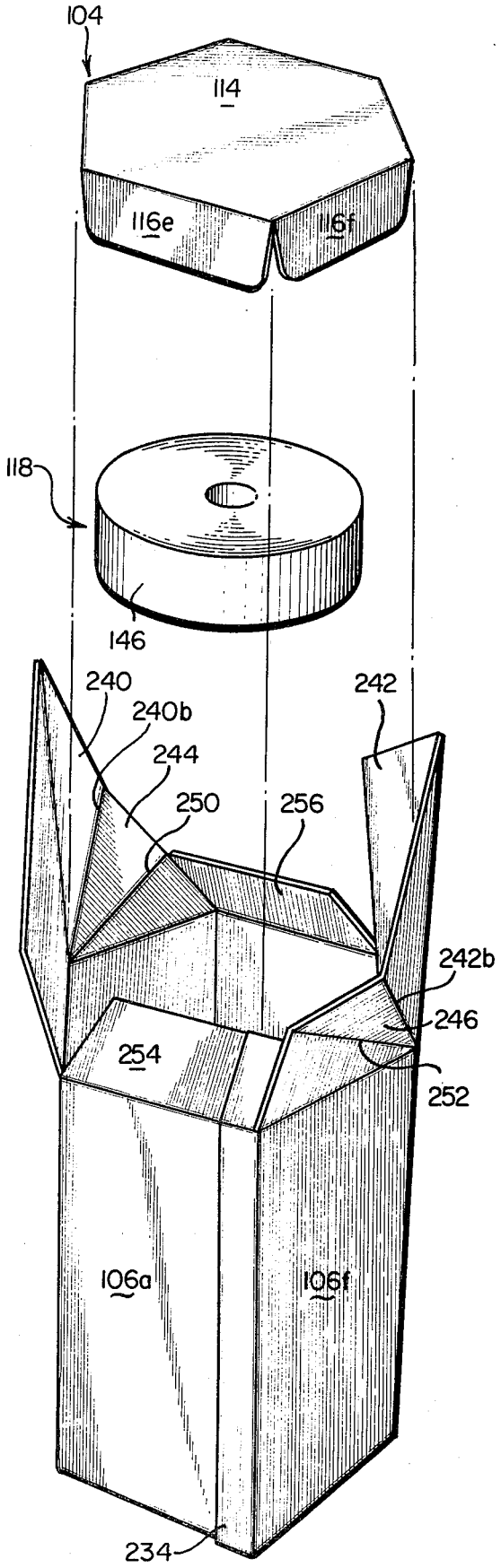
FIG. 30 is an exploded top perspective view of the polygonal container embodiment of FIG. 29 further showing spirally wound bottom reinforcement insert for use in conjunction with the container bottom assembly.
Figure 31:
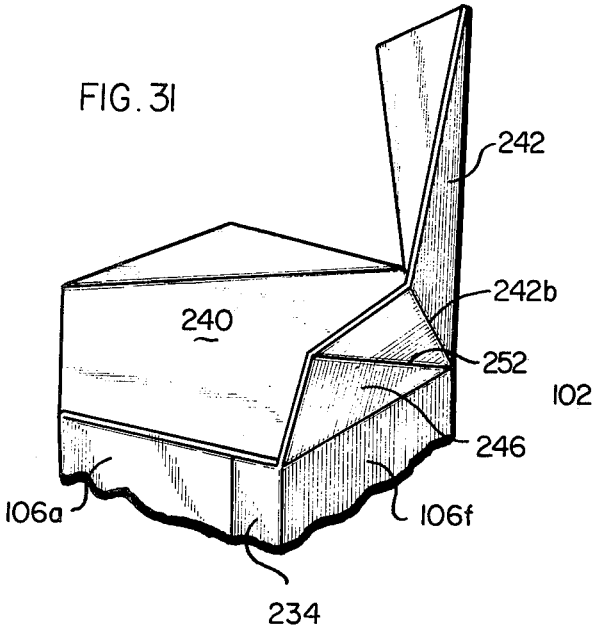
FIG. 31 is a perspective view of the top of the polygonal container of FIG. 29 showing the polygonal cover panel folded upwardly to illustrate the functional mechanism of its associated polygonal cover panel hinge.
Figure 32:
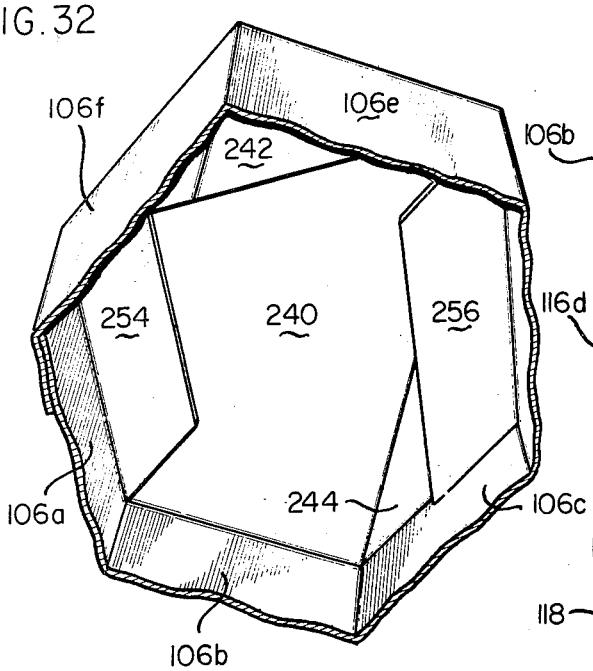
FIG. 32 is a fragmented bottom perspective view of the foldable cap assembly of the polygonal container as shown in FIG. 29.
Figure 33:
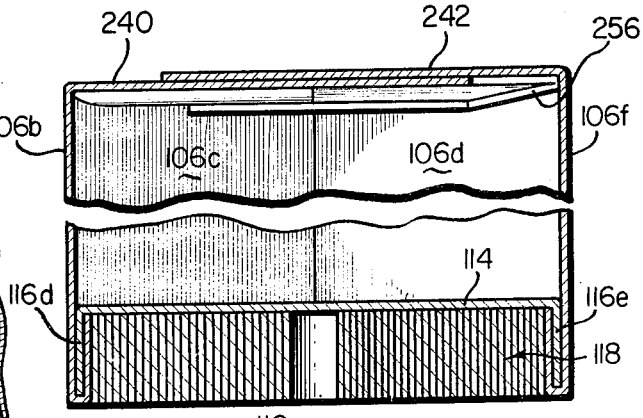
FIG. 33 is a fragmented cross-sectional view taken along line 33—33 of FIG. 29 showing the folded cap assembly and the spiral bottom reinforcement insert.
Figure 34:
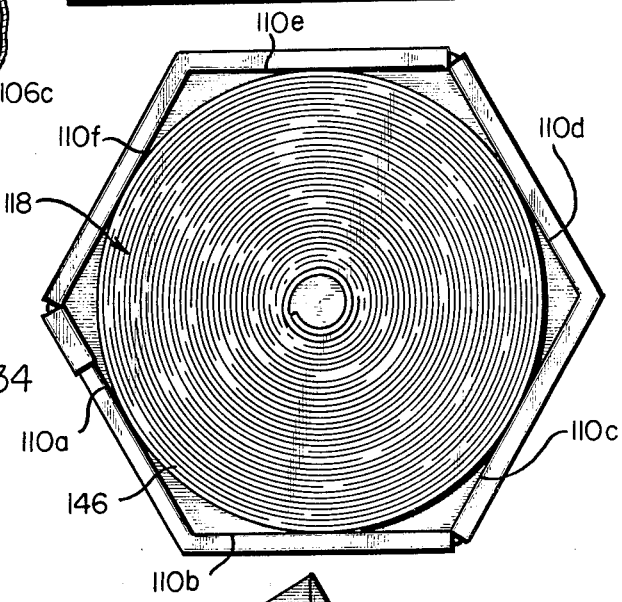
FIG. 34 is a bottom view of the polygonal container of FIG. 29 showing the interlocking relationship between the slotted lower edge flaps of the container sides assembly and the ear members of the container bottom assembly, and further showing the spirally wound reinforcement insert.

As shown in FIGS. 30, 33 and 34, in other alternative preferred embodiments the reinforcement means 118 may comprise a strip 146 of flexible material which is spirally wound to form a cylindrical body 148, as shown in FIG. 30. Cylindrical body 148 has a diameter of such size and shape as to fit snugly with respect to lower edge flaps 110*a–f* of container sides assembly 102 when container sides assembly 102 is disposed in interlocking engagement with container bottom assembly 104. Such polygonal containers may have from twelve (12) to twenty-four (24) sides, although a lesser number of sides, such as the hexagonal shape as shown, is meant to be included within the scope of the present invention.

Figure 7:
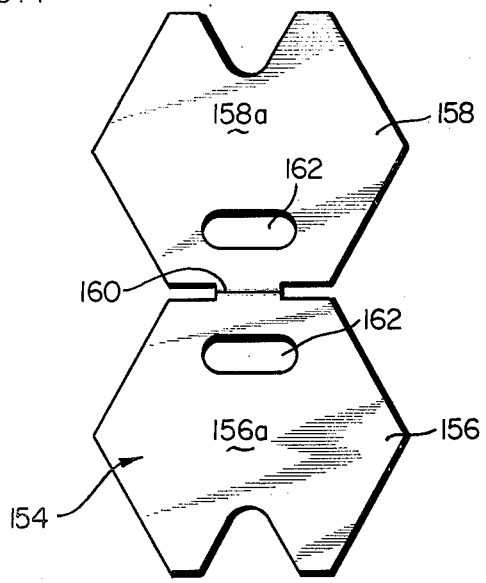
FIG. 7 is a plan view of the hingedly connected polygonal stacking panels as shown disposed atop the polygonal container in FIG. 1.

As shown in FIG. 4, the polygonal container of the present invention 100 may further include a stacking cavity 148 at the bottom thereof bounded by bottom reinforcement means 118 lower surface 150 and lower edge flaps 110*a–f*. Corresponding cover means generally 152 in the form of a lid assembly for covering the opening at the top of the polygonal container enclosure may include thereon a mating stacking means 154 projecting above the surface thereof for engagement with stacking cavity 148 of another polygonal container 100. Stacking means 154 and stacking cavity 148 are preferably of such corresponding size and shape to fit substantially snugly together as shown in FIG. 4, whereby stable stacking of containers may be maintained as shown in FIG. 1. As shown in FIG. 7, one preferred embodiment for such stacking means 154 includes at least two polygonal stacking panels 156, 158 hingedly connected by hinge 160 at polygonal sides thereof for reflexively folding together into intimate contact of the respective faces 156*a*, 158*a* thereof to form a stacking block of substantial thickness for stacking engagement with stacking cavity 148. Alternatively, a solid block of material, such as styrofoam, may be utilized.

One preferred embodiment of the polygonal container 100 of the present invention may further include, in conjunction with lid assembly 152 having an aperture 160 therein, a handle grip reinforcement means generally 164 for use when the container is manually grasped and handled, as shown in FIGS. 2, 4, 6 and 9. Such handle grip reinforcement means 164 preferably comprises a grip member 166 which is hingedly connected at the proximal portion 168 thereof to the top edge of rectangular side panel 106*f* forming the proximate polygonal side and projecting laterally across the opening to a position adjacent lid aperture 162. Such handle grip reinforcement grip member 166 is preferably reflexively foldable at a central portion 170 thereof and has a mating tab at the distal end 174 thereof for interlocking engagement with a horizontal slot means 176 contained in the top portion of the corresponding rectangular side panel 106*f*.

Figure 9:
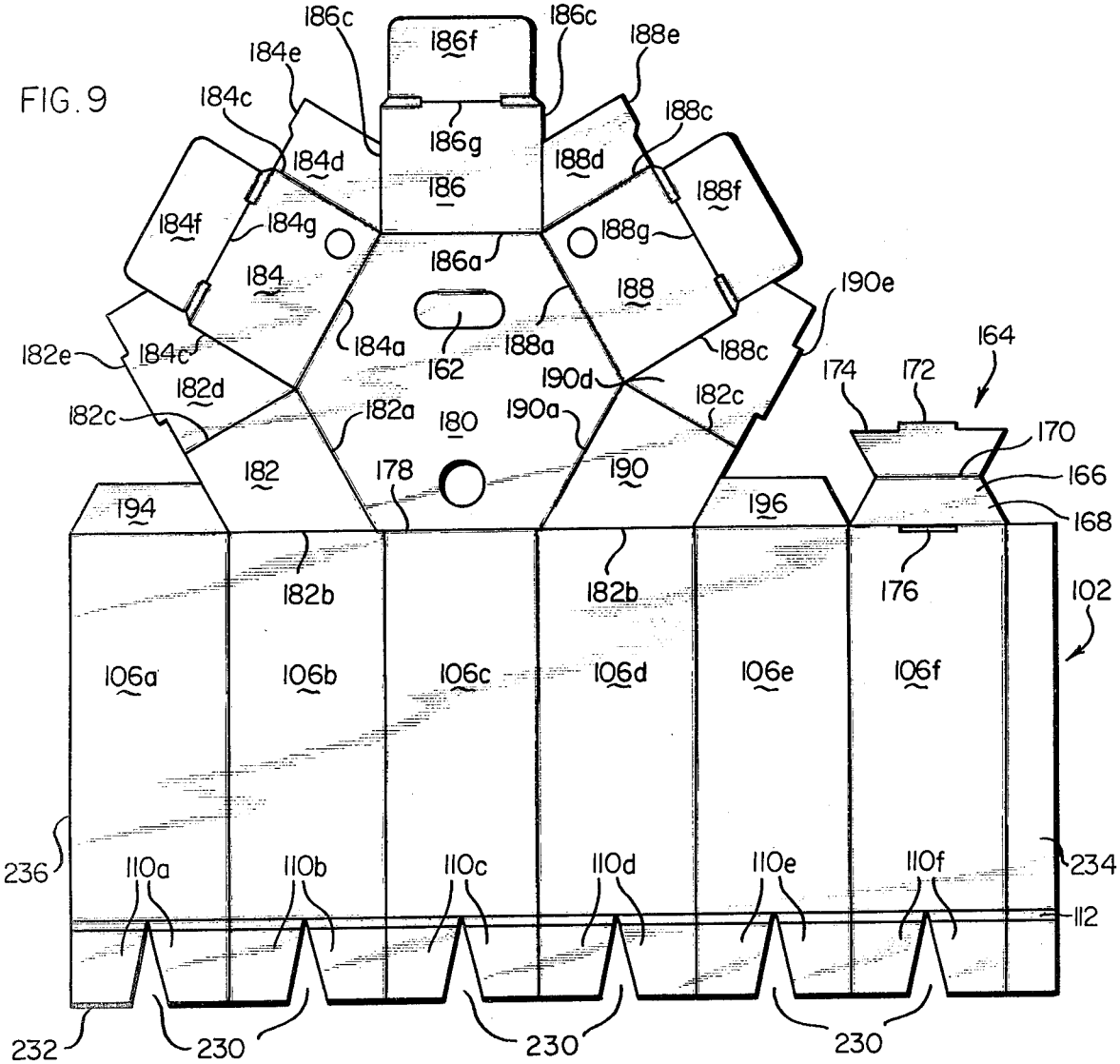
FIG. 9 is a plan view of a unitary blank for forming the container sides assembly, attached lid assembly, and attached handle grip reinforcement means, the lid assembly having a polygonal top panel with attached lid side panels and interlocking means provided therefor.
Figure 10:
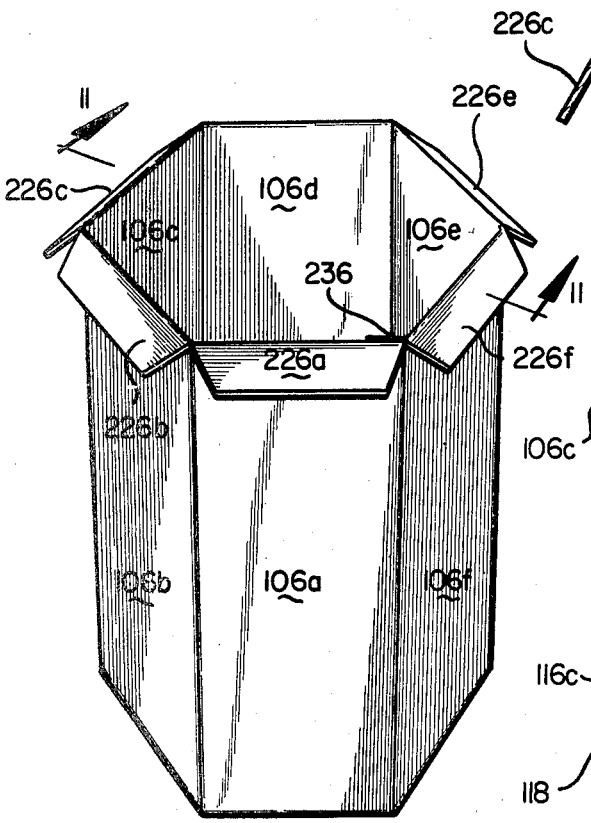
FIG. 10 is a top perspective view of an alternative preferred embodiment of the polygonal container of the present invention showing the container sides assembly thereof.

Polygonal container 100 of the present invention preferably includes lid assembly 152 which is hingedly connected to one of the rectangular side panels 106*c* at the top edge thereof as shown especially in FIGS. 2, 6 and 9. Lid assembly 152 preferably comprises a polygonal top panel 180 of sufficient size and shape to cover opening 108 at the top of the enclosure formed by polygonal container 100. As shown especially in FIG. 9, a plurality of lid side panels 182, 184, 186, 188, 190, being one less in number than the number of polygonal sides of polygonal container 100, are each hingedly connected at respective proximal portions thereof to polygonal sides 182*a*, 184*a*, 196*a*, 188*a*, and 190*a* of polygonal top panel 180. Each lid side panel 182, 184, 186, 188, 190 is disposable downwardly when in assembled configuration into contacting relationship with the top portion of the corresponding rectangular top panels of the container sides assembly to close the opening at the top of the enclosure formed by the polygonal container, as shown in FIG. 1 in particular. A pair of the lid side panels 182, 190 are connected to second and third lid polygonal sides 182*a*, 190*a* adjacent to the first hinged polygonal lid side 186*a*. As shown particularly in FIG. 6, each of the second and third lid polygonal sides 182*a*, 190*a* has a free side edge 182*b*, 190*b* and an abutting side edge 182*c*, 190*c*. The remainder of the lid side panels 184, 186, 188 have two opposed abutting side edges 184*c*, 186*c*, 188*c* when the lid side panels are disposed downwardly into an assembled configuration.

A plurality of interlocking panels 182*d*, 184*d*, 188*d*, 190*d*, being two less in number than the number of polygonal sides of the polygonal container, are each hingedly connected to opposed side edges 182*c*, 184*c*, 188*c*, 190*c* of corresponding lid side panels 182, 184, 188, 190. Each such side panel bears a locking protrusion 182*e*, 184*e*, 188*e*, 190*e* thereon. Each of a plurality of securement panels 184*f*, 186*f*, 188*f*, being three less than the number of sides of the polygonal container, is hingedly connected at its proximal end to the distal end of lid side panels 184, 186, 188. Each such securement panel has a locking slit 184*g*, 186*g*, 188*g* disposed at the hinged connection with corresponding lid side panel 184, 186, 188 for mating engagement with such locking protrusion, thereby to secure the lid in assembled configuration.

Lid assembly 152 and container sides assembly 102 preferably further include lid securement means for removably securing the assembled lid 152 atop the assembled container sides assembly 102. The lid securement means whose functioning is best seen in FIG. 5 preferably comprises securement release access aperture 192, 192 disposed in lid side panels 184, 188 to form an apertured lid side panel. Lid securement flaps 194, 196 are hingedly disposed at the top edge of the rectangular side panels 106*a*, 106*e* corresponding to each of the apertured lid side panels. Each of the lid securement flaps 194, 196 is foldable outwardly and downwardly for locking engagement with the corresponding securement panel distal edge 184*h*, 188*h*. The result of such structure is that, when the lid assembly is in assembled configuration, it may be disposed over the top portion of the container sides assembly 102 to slide over and lockingly engage lid securement flaps 194, 196. Thereafter, the lid securement flaps may be manually pressed and disposed slightly inwardly through the securement release access apertures 192, 192 to disengage lid securement flaps 194, 196 from securement panel distal edges 182*d*, 190*d* for removing lid assembly 152.

Figure 22:
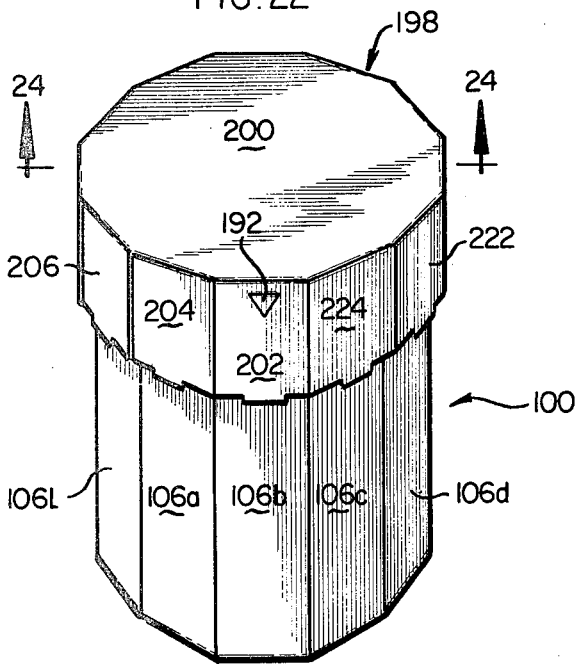
FIG. 22 is a top perspective view of a further preferred alternative embodiment of the polygonal container of the present invention having twelve sides and having a corresponding detachable lid assembly.
Figure 23:
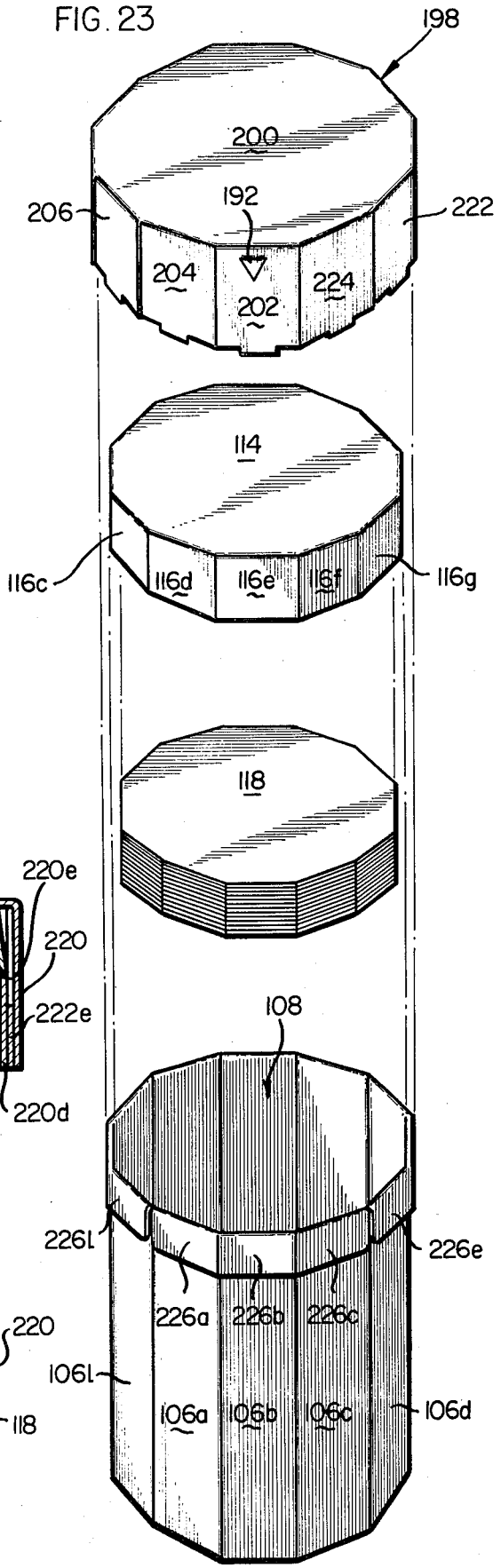
FIG. 23 is an exploded top perspective view of the twelve-sided container of FIG. 22 showing the bottom reinforcement insert, the container sides assembly, the container bottom assembly, and the detachable lid therefor.
Figure 24:
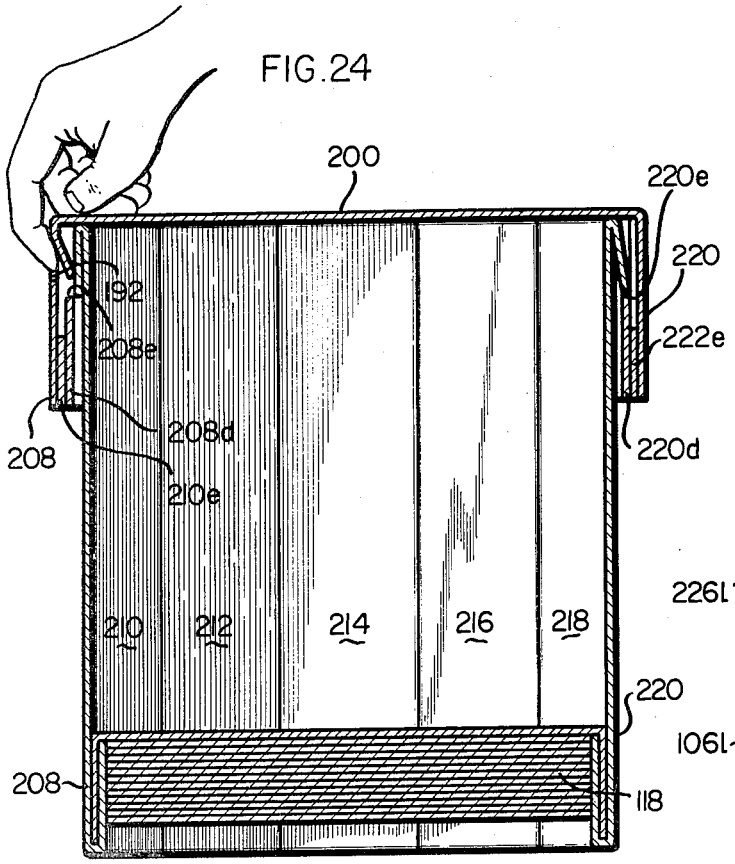
FIG. 24 is a perspective view taken along line 24—24 of FIG. 22 showing the operation of the securement means for removably securing the lid assembly.

Polygonal container 100 of the present invention may have a polygonal lid generally 198 provided for use in connection therewith, as shown in FIGS. 22–28, which functions in some respects similarly to the embodiment shown in FIGS. 2, 4, 6 and 9. Polygonal lid 198 includes a polygonal top panel 200 having a number of polygonal sides the same in number as the number of sides of the corresponding polygonal container 100 as shown in FIG. 22. Polygonal top panel 200 is of such size and shape to correspond substantially to the size and shape of the opening 108 at the top of the polygonal container. A plurality of lid side panels 202, 204, 206, 208, 210, 212, 214, 216, 218, 220, 222, 224 are provided, being the same in number as the number of sides of the polygonal container, each having oppositely disposed upper edges 202*a* et seq., lower edges 202*b* et. seq., and opposed side edges 202*c* et. seq. Each lid side panel is hingedly connected at a proximal edge thereof to a polygonal side of the polygonal top panel for foldable disposition downwardly and substantially normal to the polygonal top panel to dispose adjacent lid side panels in substantially contacting relationship at the opposed sides thereof.

Also included are means for maintaining the opposed sides in substantially contacted relationship. Securement panels 202*d* et. seq. are hingedly connected to the distal edge 202*b* et. seq. of each lid side panel with the respective securement panel being reflexively foldable upwardly to dispose each securement panel into intimate proximity to the interior surface of each of the lid side panels. Interlocking panels 202*e* et.seq. are provided for interlocking the respective lid side panels 200 et. seq. by the mechanism as shown in greater detail in connection with FIGS. 2 and 6. Further included are lid securement means for removably securing the polygonal top on the assembled container. The lid securement means includes securement release access aperture 192 disposed on lid side panels 202, 208, 214, 220 to form apertured lid side panels. Lid securement flaps 226*a*–226*e* are hingedly disposed at the top edges of rectangular side panels 106*a*–106*e* corresponding to each of the apertures of the side panels. Each lid securement panel 202*d* et. seq. is foldable outwardly and downwardly for locking engagement with the corresponding securement panel distal edge 202*f* et. seq. The result is that when in assembled configuration lid assembly 200 may be disposed over the top portion of the container sides assembly to slide over and lockingly engage lid securement flaps 226*a*–226*e*.

Figure 12:
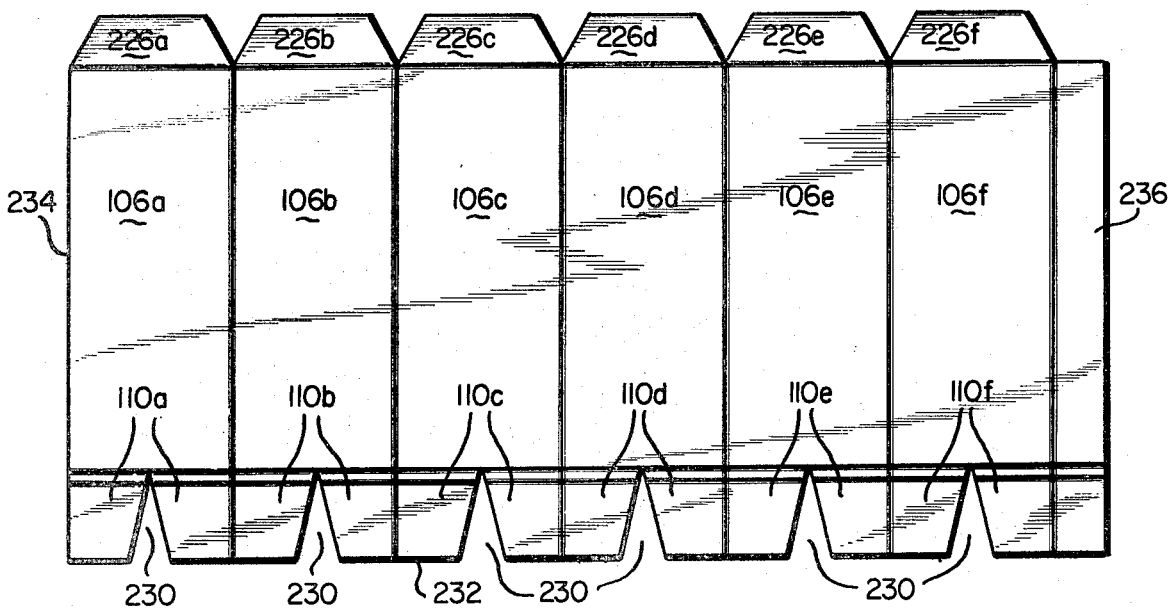
FIG. 12 is a plan view of a unitary blank for forming the container sides assembly as shown in FIG. 10.
Figure 13:
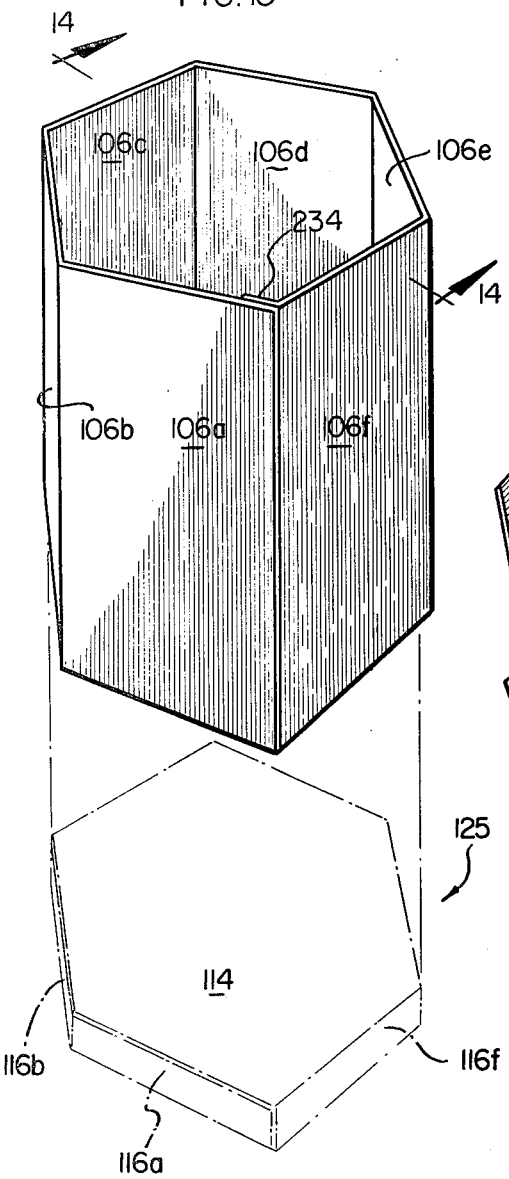
FIG. 13 is an exploded top perspective view of container sides assembly showing the insertion therein of a preferred embodiment of bottom reinforcement means for operative utilization therewith.
Figure 15:
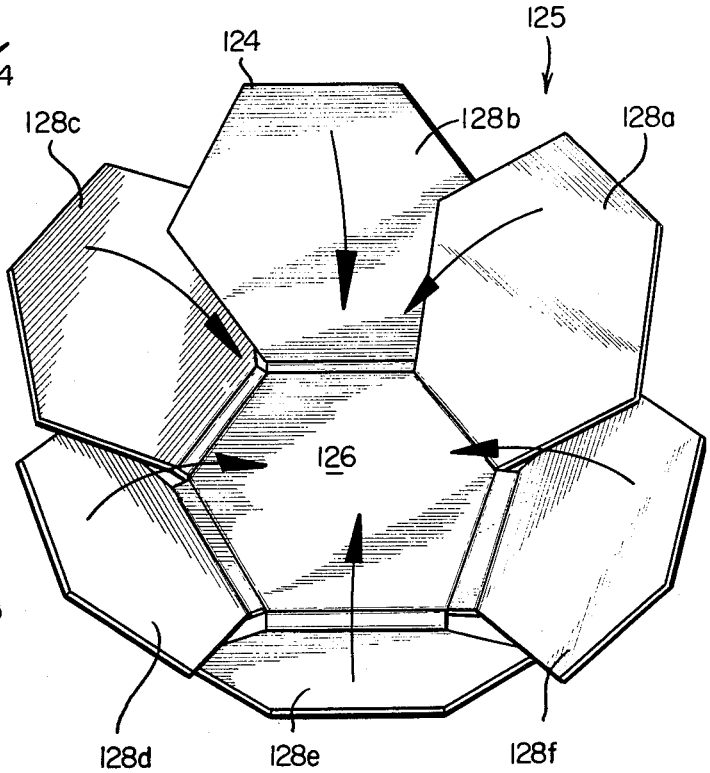
FIG. 15 is a perspective view of a partially assembled bottom reinforcement insert having a polygonal central bottom reinforcement panel and attached supplemental bottom reinforcement panels which are reflexively folded onto the polygonal central panel as shown by arrows to form a multi-layered configuration having a substantial thickness.
Figure 14:
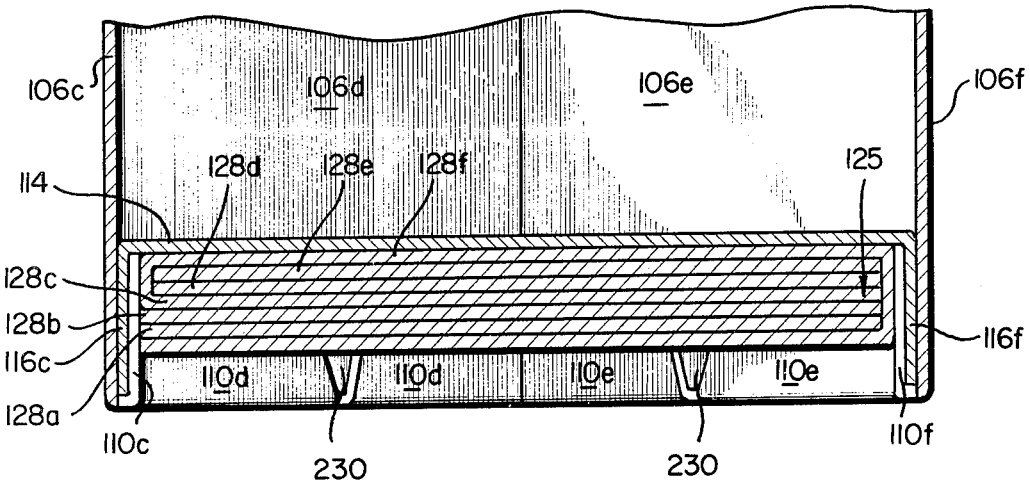
FIG. 14 is a fragmented cross-sectional view taken along line 14—14 of FIG. 13 showing the multi-layered and reflexively folded bottom reinforcement insert disposed in relationship to the container bottom assembly for reinforcement thereof.
Figure 16:
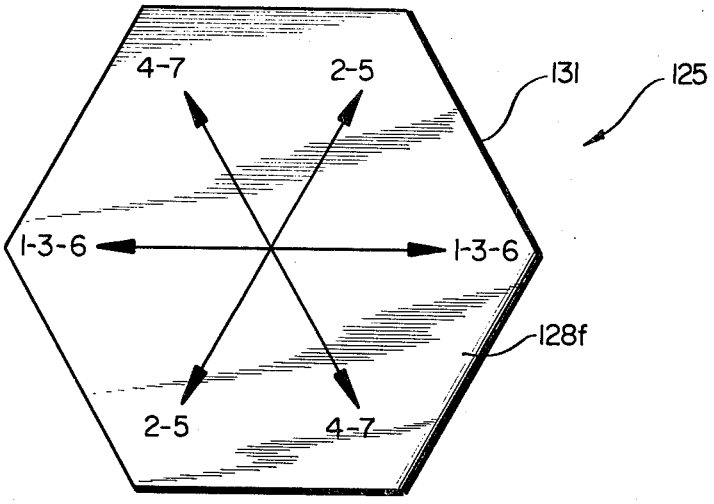
FIG. 16 is a top view of the multi-layered bottom reinforcement insert as shown in FIG. 15 and further illustrating the resistance to bending in any direction achieved by means of the overlapping multi-layered configuration.
Figure 25:
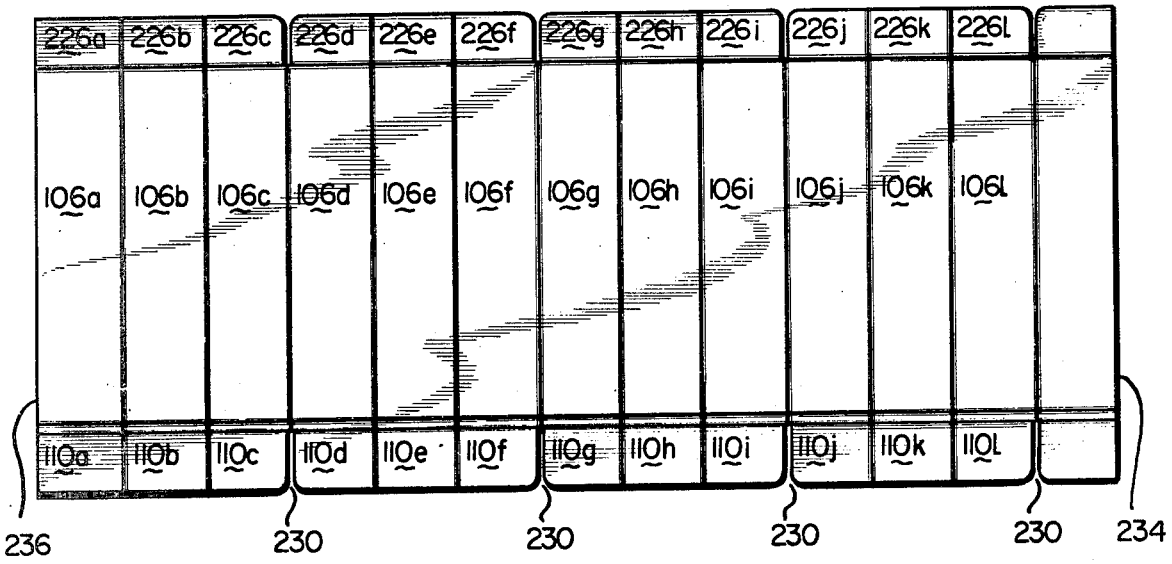
FIG. 25 is a plan view of a unitary blank for forming the container sides assembly of the embodiment of the polygonal container of the present invention shown in FIG. 22.
Figure 26:
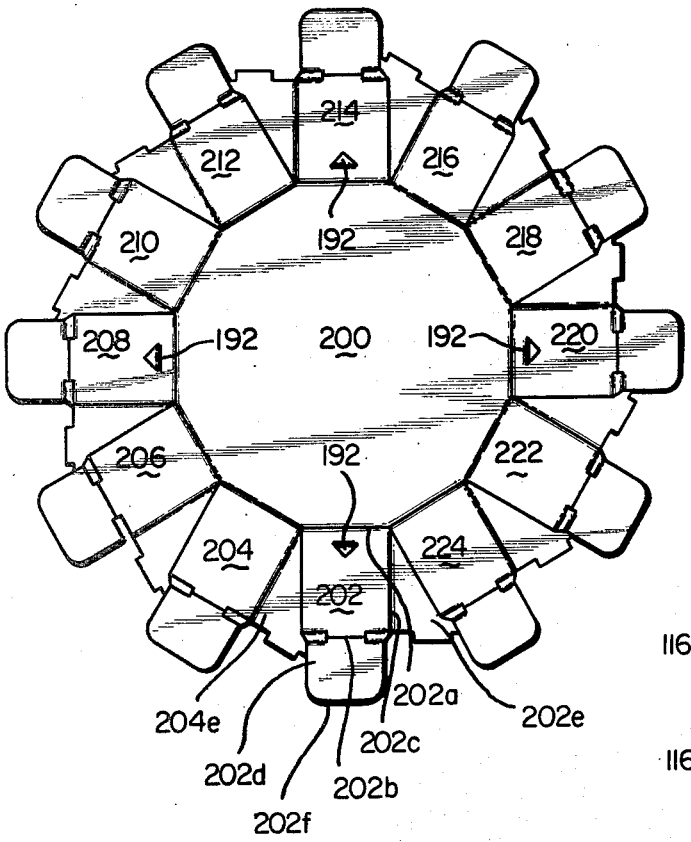
FIG. 26 is a plan view of a unitary blank for forming the detachable lid assembly shown in FIG. 22.
Figure 27:
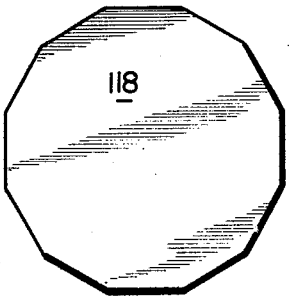
FIG. 27 is a top view of the twelve-sided bottom reinforcement insert shown in FIG. 23.
Figure 28:
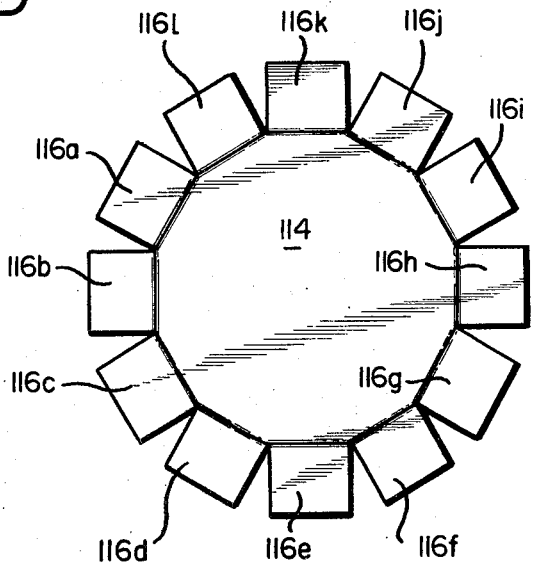
FIG. 28 is a plan view of the twelve-sided container bottom assembly as shown in FIG. 23.
Figure 29:
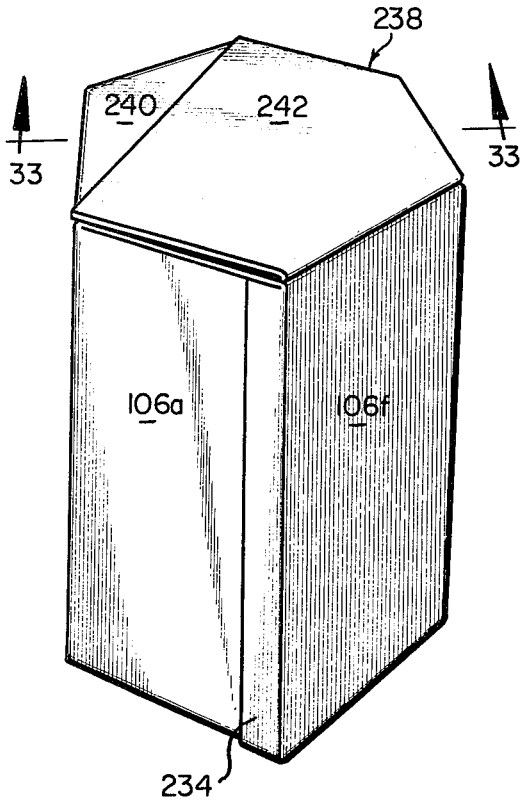
FIG. 29 is a top perspective view of a yet additional preferred embodiment of the polygonal container of the present invention also showing a foldable cap assembly therefor.
Figure 35:
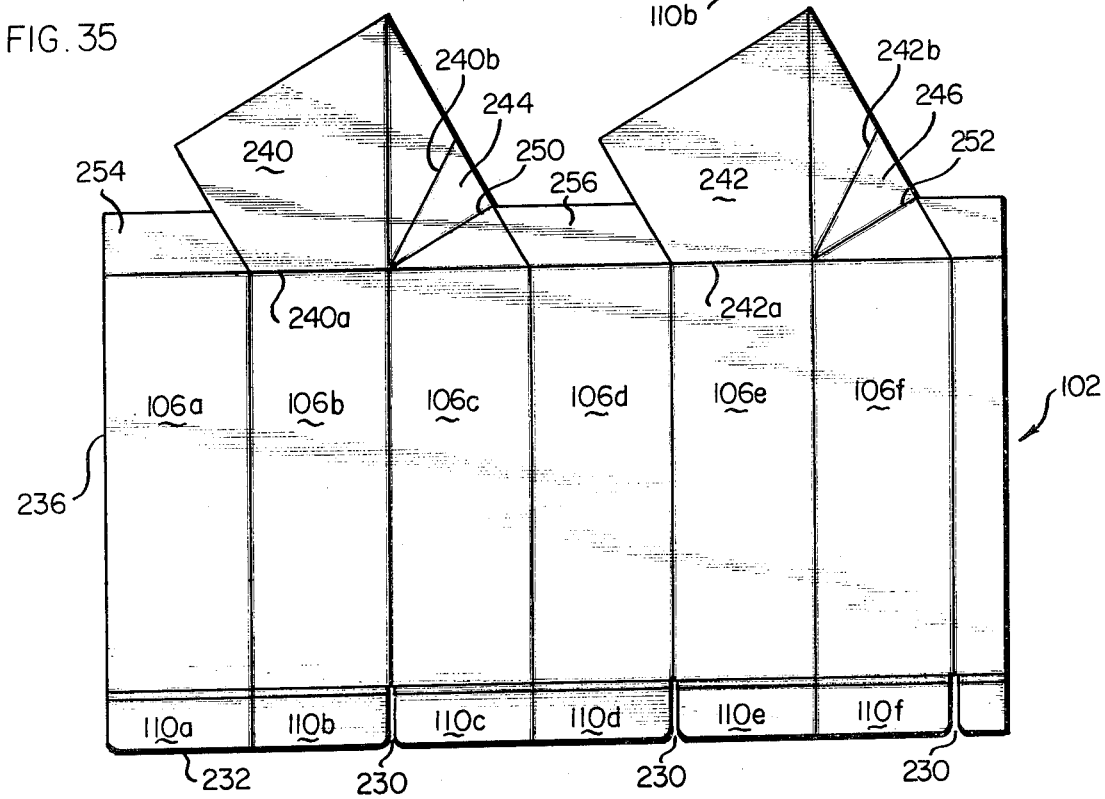
FIG. 35 is a plan view of a unitary blank for forming both the container sides assembly and the container cap assembly illustrated in FIG. 29.

The polygonal container of the present invention may preferably have lower edge flaps 110 and corresponding engaging ear members 116 which are equal in number. The number of sides of the polygonal container may be three or greater, preferably six in some embodiments and twelve to twenty-four in others. The lower edge flaps of the container sides assembly are preferably separated from each other by slits 230 extending from the lower extremity 232 of container sides assembly 102 to the corresponding rectangular side panel 106 thereby to render lower edge flaps 110 more easily foldable upwardly in engagement with ear members 110 of container bottom assembly 102. Such slits 230 may preferably extend from the lower extremity 232 of the container to a point preferably disposed between two adjacent rectangular side panels as shown in FIGS. 25 and 35 to permit greater ease in folding the lower edge flaps upwardly. Alternatively, such slits 230 may extend to a point dividing the lower edge of an individual rectangular side panel, as shown in FIGS. 9 and 12.

The container sides assembly 102 may further preferably include a longitudinally extending side flap 234 hingedly disposed therefrom, with the panel disposed at the opposite side of the blank having a free edge 236 for receiving the longitudinally extending side flap, thereby to form the enclosure of the polygonal container.

As shown in particular in FIGS. 29–35, polygonal container 100 of the present invention may also include in preferred embodiments a cap assembly generally 238 for covering the opening at the top of the enclosure formed by the polygonal container. The cap assembly preferably includes overlapping polygonal cover panels 240, 242 hingedly attached at first polygonal sides 240*a*, 242*a* thereof to the top edge of rectangular side panels 106*b*, 106*e*. Polygonal cover panels 240, 242 are foldable generally normal to rectangular side panels 106*b*, 106*e* for covering the top opening of polygonal container 100. Polygonal cover hinges 244, 246 are foldably attached to the polygonal cover panels 240, 242 at second polygonal sides 240*b*, 242*b* which are respectively adjacent to first polygonal sides 240*a*, 242*a*. Polygonal cover hinges 244, 246 are also foldably attached at the top edge of second rectangular side panels 106*c*, 106*f* which are adjacent respectively to the first rectangular side panels 106*b*, 106*f*. Polygonal cover hinges 244, 246 are wedge-shaped to span the angle between the respective second polygonal sides 240*b*, 242*b* of polygonal cover panels 240, 242 and between the top edges of the respective second rectangular side panels 106*c*, 106*f*, the angle being generally bisected by respective fold lines 250, 252 thereby forming the hinged structure. The functioning of that structure is such that, when polygonal cover panels 240, 242 are disposed normal to the respective rectangular side panels 106*b*, 106*e*, the second polygonal sides 240*b*, 242*b* of polygonal cover panels 240, 242 are disposed onto the top edges of rectangular side panels 106*c*, 106*f* to cover the opening at the top of the enclosure formed by polygonal container 100.

Polygonal cover panels 240, 242 may be separated by two intervening rectangular side panels. Supplemental cover panels 254, 256 of lesser size than polygonal cover panels 240, 242 may be provided for supplemental support to polygonal cover panels 240, 242 when they are disposed in such folded and covering relationship.

The material preferably utilized for construction of polygonal containers of the present invention is a rigid but foldable material. Materials which have proved to be notably successful have been corrugated materials.

The basic and novel characteristics of the polygonal container of the present invention will be readily understood from the foregoing disclosure by those skilled in the art. It will become readily apparent that various changes and modifications may be made in the form, construction and arrangement of the polygonal container of the present invention as set forth hereinabove without departing from the spirit and scope of the invention. Accordingly, the preferred and alternative embodiments of the present invention set forth hereinabove are not intended to limit such spirit and scope in any way.

What is claimed is:

1. A polygonal container having a container sides assembly and a container bottom assembly which is adapted for interlocking engagement with said container sides assembly at the lower portion thereof for forming the container bottom:

said container sides assembly comprising:

a plurality of generally rectangular side panels hingedly interconnected to form an enclosure defining the sides of the polygonal container; and a plurality of lower edge flaps each connected to the lower edge of a corresponding rectangular side panel to form a container sides assembly lower edge hinge, said lower edge flaps reflexively folded at the lower edge hinges upwardly and inside the enclosure to form an interlocking fold space between each said lower edge flap and the corresponding said rectangular side panel, each said interlocking fold space adapted for receiving the corresponding element from said container bottom assembly for secure engagement between said container sides assembly and said container bottom assembly; and said container bottom assembly comprising:

a polygonal bottom panel having sides equal in number to said rectangular side panels and being of such a size to fit snugly within said container sides assembly when in assembled configuration for forming the container bottom;

a plurality of ear members equal in number to said number of sides of said polygonal bottom panel, each said ear member being connected to a corresponding side of said polygonal bottom panel at an ear member hinge and being downwardly extending from said corresponding side of said polygonal bottom panel for disposition into the interlocking fold space formed by each said upwardly extending lower edge flap and its corresponding rectangular side panel of said container sides assembly; and bottom reinforcement means corresponding generally in shape and size to said polygonal bottom panel and disposed in intimate proximity to said polygonal bottom panel to reinforce and stengthen said polygonal bottom panel.

2. The polygonal container of claim 1 wherein said bottom reinforcement means is in contact with and fixedly secured to said polygonal bottom panel at the underside thereof.

3. The polygonal container of claim 1 wherein said bottom reinforcement means is maintained in intimate proximity to said polygonal bottom panel by means of an interference fit between said bottom reinforcement means and said plurality of lower edge flaps when said lower edge flaps are folded upwardly and inside the container enclosure to interlockingly receive said ear members of said container bottom assembly.

4. The polygonal container of claim 1 wherein said bottom reinforcement means comprises an insert of a hard, resilient material.

5. The polygonal container of claim 1 wherein said bottom reinforcement means comprises an insert of styrofoam material.

6. The polygonal container of claim 1 wherein said bottom reinforcement means comprises an insert of corrugated material having a multiplicity of corrugated ribs extending normal to said polygonal bottom panel, said multiplicity of corrugated ribs disposed across substantially one face of said polygonal bottom panel to support and reinforce the entirety of the polygonal bottom panel and especially against a downwardly compressive force.

7. The polygonal container of claim 1 wherein said bottom reinforcement means comprises:

a polygonal central bottom reinforcement panel corresponding generally in size and shape to said polygonal bottom panel;

a plurality of supplemental bottom reinforcement panels, each corresponding generally in size and shape to said polygonal central bottom reinforcement panel; and hinge means disposed between one side of each supplemental bottom reinforcement panel and a corresponding side of said polygonal central bottom reinforcement panel for reflexively folding a first said supplemental bottom reinforcement panel and the others in sequence to the last supplemental bottom reinforcement means onto said polygonal central bottom reinforcement panel to form a multilayered configuration having a substantial thickness, the length of said hinge means between said supplemental bottom reinforcement panels and said polygonal central reinforcement panel increasing proportionally from said first supplemental bottom reinforcement panel, whereby said multilayered configuration once folded will tend to remain in such folded multilayered configuration without substantial application of external force.

8. The polygonal container of claim 7 wherein said polygonal bottom reinforcemental panel, said supplemental bottom reinforcement panels, and said hinge means comprise a unitary panel of corrugated material having corrugated ribs disposed generally parallel to each other and uniformly along the length of said unitary panel, whereby when said supplemental bottom panels are reflexively folded to form said multilayered configuration said corrugated ribs on adjacent supplemental bottom panels overlap each other at an acute angle to form a structure having substantially uniform flex resistance.

9. The polygonal container of claim 8 wherein the number of polygonal sides of each of said polygonal bottom panel and said corresponding bottom reinforcement means is less than seven in number.

10. The polygonal container of claim 1 wherein said bottom reinforcement means comprises:

a plurality of hingedly interconnected supplemental bottom support panels of substantially the same size and shape as said polygonal bottom panel and at least one of which is hingedly connected to said bottom support panel at a polygonal side thereof for reflexive folding onto said bottom support panel thereby to provide reinforcement thereto.

11. The polygonal container of claim 10 wherein said supplemental bottom support panels are reflexively folded onto the underside of said polygonal bottom container.

12. The polygonal container of claim 11 wherein at least one of said supplemental bottom support panels is hingedly connected directly to each of a pair of opposing polygonal sides of said polygonal bottom support panel.

13. The polygonal container of claim 12 wherein said opposingly connected supplemental bottom support panels are hingedly connected to the polygonal side of said polygonal bottom panel near the juncture of said polygonal side with the adjacent polygonal side of said polygonal bottom panel.

14. The polygonal container of claim 13 wherein one of said ear members is connected on said polygonal side interior of the connection thereof with said supplemental bottom support panel.

15. The polygonal container of claim 1 wherein said polygonal bottom panel is interlockingly secured at a substantial distance above said container sides assembly lower edge hinges, whereby any contents of said polygonal container are supported and carried substantially above the surface on which the polygonal container rests, thereby to protect such contents from damage from any liquid on such surface and to cushion such contents from vibration or movement of such surface.

16. The polygonal container of claim 1 wherein each said lower edge flap of said container sides assembly has a free edge disposed opposite to its corresponding lower edge hinge, each said free edge contacting said polygonal bottom panel in the proximity of the ear member hinge thereof to support thereby said polygonal bottom panel.

17. The polygonal container of claim 1 wherein each ear member of said polygonal bottom panel has a terminal edge disposed opposite to its corresponding lower edge hinge, each said terminal edge contacting said lower hinge within the interlocking fold space to further support said polygonal bottom panel.

18. A polygonal container having a container sides assembly and a container bottom assembly which is adapted for interlocking engagement with said container sides assembly at the lower portion thereof for forming the container bottom:

said container sides assembly comprising:

a plurality of generally rectangular side panels hingedly interconnected to form an enclosure defining the sides of the polygonal container; and a plurality of lower edge flaps hingedly connected to the lower edge of said rectangular side panels and adapted for folding upwardly and inside the enclosure to interlockingly receive corresponding elements from said container bottom assembly; and said container bottom assembly comprising:

a polygonal bottom panel having sides equal in number to said rectangular side panels and being of such a size to fit snugly within said container side assembly when in assembled configuration for forming the container bottom;

a plurality of ear members equal in number to said number of sides of said polygonal bottom panel, each of which ear members is hingedly connected to a side of said polygonal bottom panel and is downwardly extending therefrom for operative engagement with said upwardly extending lower edge flaps of said container sides assembly; and bottom reninforcement means corresponding generally in shape and size to said polygonal bottom panel and disposed in intimate proximity to said polygonal bottom panel to reinforce and strengthen said polygonal bottom panel said bottom reinforcement means comprising:

a plurality of hingedly interconnected supplemental bottom support panels of substantially the same size and shape as said polygonal bottom panel and at least one of which is hingedly connected to said bottom support panel at a polygonal side thereof for reflexive folding onto the underside of said bottom support panel thereby to provide reinforcement thereto, at least one of said supplemental bottom support panels being hingedly connected directly to each of a pair of opposing polygonal sides of said polygonal bottom support panel, and at least one supplemental bottom support panel on each opposed side of said polygonal bottom panel being foldable along a fold line dividing each said supplemental bottom support panel into substantially equal parts for reflexively folding at least said supplemental bottom support panel onto itself, whereby when said container bottom assembly is in folded configuration each said opposing supplemental bottom support panel reinforces one-half of said polygonal bottom panel.

19. The polygonal container of claim 18 wherein second supplemental bottom support panels having said fold lines thereon are hingedly connected to said oppositely disposed first supplemental bottom support panels for additional reinforcement of said polygonal bottom panel.

20. A polygonal container having a container sides assembly and a container bottom assembly which is adapted for interlocking engagement with said container sides assembly at the lower portion thereof for forming the container bottom:

said container sides assembly comprising:

a plurality of generally rectangular side panels hingedly interconnected to form an enclosure defining the sides of the polygonal container; and a plurality of lower edge flaps hingedly connected to the lower edge of said rectangular side panels and adapted for folding upwardly and inside the enclosure to interlockingly receive corresponding elements from said container bottom assembly; and said container bottom assembly comprising:

a polygonal bottom panel having sides equal in number to said rectangular side panels and being of such a size to fit snugly within said container sides assembly when in assembled configuration for forming the container bottom;

a plurality of ear members equal in number to said number of sides of said polygonal bottom panel, each of which ear member is hingedly connected to a side of said polygonal bottom panel and is downwardly extending therefrom for operative engagement with said upwardly extending lower edge flaps of said container sides assembly; and bottom reinforcement means corresponding generally in shape and size to said polygonal bottom panel and disposed in intimate proximity to said polygonal bottom panel to reinforce and strengthen said polygonal bottom panel, said bottom reinforcement means comprising a strip of substantially flexible material spirally wound to form a cylindrical body having a diameter of such size sufficient to fit snugly with respect to lower edge flaps of said container sides assembly when said container sides assembly is disposed in interlocking engagement with said container bottom assembly.

21. The polygonal container of claim 20 wherein said polygonal container has more than eleven polygonal sides.

22. A polygonal container having a container sides assembly and a container bottom assembly which is adapted for interlocking engagement with said container sides assembly at the lower portion thereof for forming the container bottom:

said container sides assembly comprising:

a plurality of generally rectangular side panels hingedly interconnected to form an enclosure defining the sides of the polygonal container; and a plurality of lower edge flaps hingedly connected to the lower edge of said rectangular side panels and adapted for folding upwardly and inside the enclosure to interlockingly receive corresponding elements from said container bottom assembly; and said container bottom assembly comprising:

a polygonal bottom panel having sides equal in number to said rectangular side panels and being of such size to fit snugly within said container sides assembly when in assembled configuration for forming the container bottom;

a plurality of ear members equal in number to said number of sides of said polygonal bottom panel, each of which ear members is hingedly connected to a side of said polygonal bottom panel and is downwardly extending thereform for operative engagement with said upwardly extending lower edge flaps of said container sides assembly; and bottom reinforcement means corresponding generally in shape and size to said polygonal bottom panel and disposed in intimate proximity to said polygonal bottom panel to reinforce and strengthen said polygonal bottom panel; and a stacking cavity disposed at the bottom of said polygonal container bounded by said bottom reinforcement means lower surface and said lower edge flaps when said container sides assembly and said container bottom assembly are disposed in interlocking engagement, said polygonal container further including means for covering the opening at the top of the enclosure formed by said rectangular side panels, said covering means including thereon stacking means projecting above the surface thereof for engagement with said stacking cavity of another said polygonal container.

23. The polygonal container of claim 22 wherein said stacking means and said stacking cavity are such corresponding size and shape to fit substantially snugly together whereby stable stacking of several such polygonal containers may be maintained.

24. The polygonal container of claim 23 wherein said stacking means comprises at least two polygonal stacking panels hingedly connected at polygonal sides thereof for reflexively folding together into intimate contact of the respective faces thereof to form a stacking block of substantial thickness for said stacking engagement with said stacking cavity.

25. The polygonal container of claim 24 wherein said polygonal container further includes:

lid means for covering the opening at the top of the enclosure formed by said rectangular side panels, said lid means having a lid aperture disposed sufficiently near a proximate polygonal side of said polygonal container for manually grasping and handling said lid means and thereby said polygonal container; and handle grip reinforcement means hingedly connected at the proximal portion thereof to the top edge of the rectangular side panel forming said proximate polygonal side and projecting laterally across said opening to a position adjacent said lid aperture whereby said handle grip reinforcement means is manually graspable in handling said polygonal container.

26. The polygonal container of claim 25 wherein said proximate rectangular side panel includes horizontal slot means disposed near said hinged connection between said handle grip reinforcement means and said proximate rectangular side panel and handle grip reinforcement means comprises a grip member reflexively foldable at a central portion thereof and containing at the distal portion thereof a mating tab for locking engagement with said horizontal slot means.

27. A polygonal container having a container sides assembly and a container bottom assembly which is adapted for interlocking engagement with said container sides assembly at the lower portion thereof for forming the container bottom:

said container sides assembly comprising:

a plurality of generally rectangular side panels hingedly interconnected to form an enclosure defining the sides of the polygonal container; and a plurality of lower edge flaps hingedly connected to the lower edge of said rectangular side panels and adapted for folding upwardly and inside the enclosure to interlockingly receive said polygonal to panel, each said lid side panel disposable downwardly when in assembled configuration into contacting relationship with the top portion of the corresponding rectangular side panels of said container sides assembly to close the opening at the top of said enclosure formed by said container sides assembly, each said lid side panel having opposed side edges, a pair of said lid side panels being connected to second and third said lid polygonal sides are immediately adjacent said first lid polygonal side, each of said second and third lid polygonal sides having a free side edge and an abutting side edge, and the remainder of said lid side panels having two opposed abutting side edges when said lid side panels are disposed downwardly in said assembled configuration;

a plurality of locking panels, being two less in number than the number of polygonal sides of the polygonal container, each of which is hingedly connected to an opposed side edge of a corresponding lid side panel, and each of which bears a locking protrusion thereon; and a plurality of securement panels, being three less in number than the number of sides of said polygonal container, each of which is hingedly connected at its proximal end to the distal end of one of said remainder of said lid side panels, and each said securement panel having a lock slit at the hinged connection with said corresponding lid side panel for mating engagement with said locking protrusion thereby to secure said lid in assembled configuration.

28. The polygonal container of claim 27 wherein said lid and said container sides assembly further include lid securement means for removably securing said assembled lid atop said assembled container sides assembly, said lid securement means comprising:

a securement release access aperture disposed in at least one of said remainder of said lid side panels to form an apertured lid side panel;

a lid securement flap hingedly disposed at the top edge of the rectangular side panel corresponding to each said apertured lid side panel, each said lid securement flap foldable outwardly and downwardly for locking engagement with said corresponding securement panel distal edge, whereby when in assembled configuration said lid may be disposed over said top portion of said container sides assembly to slide over and lockingly engage said lid securement flaps, and whereby said lid securement flaps may be pressed and disposed slightly inwardly through said securement release access aperture thereby to disengage said lid securement flap from said securement panel distal edge for removing said cover.

29. A polygonal container having a container sides assembly and a container bottom assembly which is adapted for interlocking engagement with said container sides assembly at the lower portion thereof for forming the container bottom:

said container sides assembly comprising:

a plurality of generally rectangular side panels hingedly interconnected to form an enclosure defining the sides of the polygonal container; and a plurality of lower edge flaps hingedly connected to the lower edge of said rectangular side panels and adapted for folding upwardly and inside the enclosure to interlockingly receive corresponding elements from said container bottom assembly; and said container bottom assembly comprising:

a polygonal bottom panel having sides equal in number to said rectangular side panels and being of such a size to fit snugly within said container sides assembly when in assembled configuration for forming the container bottom;

a plurality of ear members equal in number to said number of sides of said polygonal bottom panel, each of which ear members is hingedly connected to a side of said polygonal bottom panel and is downwardly extending therefrom for operative engagement with said upwardly extending lower edge flaps of said container sides assembly;

bottom reinforcement means corresponding generally in shape and size to said polygonal bottom panel and disposed in intimate proximity to said polygonal bottom panel to reinforce and strengthen said polygonal bottom panel; and a polygonal lid for said polygonal container, said polygonal container having an opening at the top thereof and a selected number of sides defining the opening, said polygonal lid comprising:

a polygonal top panel having a number of polygonal sides which number is the same as the number of sides of the polygonal container, said polygonal top panel being of such size and shape as to correspond substantially to the size and shape of the opening at the top of the polygonal container;

a plurality of lid side panels being the same in number as the number of sides of the polygonal container, each said lid side panel having oppositely disposed upper and lower edges and opposed side edges, and each said lid side panel being hingedly connected at the proximal edge thereof to a polygonal side of said polygonal top panel, each said lid side panel being adapted for folded disposition downwardly substantially normal to said polygonal top panel to dispose adjacent said lid side panels in substantially contacting relationship at the opposed sides thereof when in such assembled disposition;

means for maintaining said opposed sides in said substantially contacting relationship and maintaining means including a securement panel hingedly connected to the distal edge of each said lid side panel, each said securement panel reflexively foldable upwardly to dispose each said securement panel into intimate proximity to the interior surface of each said lid side panel; and lid securement means for removably securing said polygonal top on said assembled container sides assembly, said lid securement means comprising:

a securement release access aperture disposed in at least one of said lid side panels to form an apertured lid side panel; and a lid securement flap hingedly disposed at the top edge of the rectangular side panel corresponding to each said apertured lid side panel, each said lid securement flap foldable outwardly and downwardly for locking engagement with said corresponding securement panel distal edge, whereby when in assembled configuration said lid may be disposed over said top portion of said container sides assembly to slide over and lockingly engage said lid securement flaps, and whereby said lid securement flaps may be pressed and disposed slightly inwardly through said securement release access aperture thereby to disengage said lid securement flap from said securement panel distal edge for removing said cover.

30. The polygonal container of claim 1 wherein said lower edge flaps and said corresponding and engaging ear members are equal in number.

31. The polygonal container of claim 1 wherein the number of said rectangular side panels is even and greater than two.

32. The polygonal container of claim 1 wherein the number of said rectangular side panels is odd and greater than one.

33. The polygonal container of claim 1 wherein at least one of said lower edge flaps of said container sides assembly is separated from an adjacent lower edge flap by a slit extending from the lower extremity of said container sides assembly to the said corresponding rectangular side panel, whereby said lower edge flaps are more easily folded upwardly for engagement with said ear members of said container bottom assembly.

34. The polygonal container of claim 33 wherein said slits separating said lower edge flaps from each other extend from said lower extremity of said container sides assembly to a point disposed between two adjacent rectangular side panels to permit folding of each lower edge flap upwardly to correspond to each individual rectangular side panel of said container sides assembly.

35. The polygonal container of claim 33 where said slits separating said lower flaps from each other extend from said lower extremity of said container sides assembly to a point on a single rectangular side paenl to permit engagement of a single ear member of said container bottom assembly with two adjacent lower edge flaps, whereby the strength and stability of the engagement between said container bottom assembly and said container sides assembly of the polygonal container is enhanced.

36. The polygonal container of claim 1 wherein said container sides assembly is foldably formed from a unitary blank of relatively rigid, but foldable, material and one said panel of said container sides assembly has an edge with a longitudinally extending side flap hingedly disposed therefrom, with the panel disposed at the opposite side of said blank having a free edge for receiving said longitudinally extending side flap, thereby to form an enclosure by means of said rectangular side panels.

37. A polygonal container and integral foldable cap assembly therefor, said container having a container sides assembly and a container bottom assembly which is adapted for interlocking engagement with said container sides assembly at the lower portion thereof for forming the container bottom:

said container sides assembly comprising:

a plurality of generally rectangular side panels hingedly interconnected to form an enclosure defining the sides of the polygonal container; and a plurality of lower edge flaps hingedly connected to the lower edge of said rectangular side panels and adapted for folding upwardly and inside the enclosure to interlockingly receive corresponding elements from said container bottom assembly; and a polygonal bottom panel having sides equal in number to said rectangular side panels and being of such a size to fit snugly within said container sides assembly when in assembled configuration for forming the container bottom;

a plurality of ear members equal in number to said number of sides of said polygonal bottom panel, each of which ear members is hingedly connected to a side of said polygonal bottom panel and is downwardly extending therefrom for operative engagement with said upwardly extending lower edge flaps of said container sides assembly;

bottom reinforcement means corresponding generally in shape and size to said polygonal bottom panel and disposed in intimate proximity to said polygonal bottom panel to reinforce and strengthen said polygonal bottom panel; and said foldable cap assembly for covering the opening at the top of the enclosure formed by the polygonal container comprising:

at least one polygonal cover panel hingedly attached at a first polygonal side thereof to the top edge of a first rectangular side panel and foldable generally normal thereto for covering the top opening of the polygonal container; and a polygonal cover panel hinge foldably attached at a second polygonal side thereof, which second polygonal side is adjacent said first polygonal side, said polygonal cover panel hinge also foldably attached to the top edge of a second rectangular side panel, which second rectangular side panel is adjacent to said first rectangular side panel, said polygonal cover panel hinge being wedgeshaped to span the angle between said second polygonal side of said polygonal cover panel and between said top edge of said second rectangular side panel, said angle being generally bisected by a fold line, whereby when said polygonal cover panel is disposed normal to said first rectangular side panel said second polygonal side of said polygonal panel is disposed onto said top edge of said second rectangular side panel to cover the opening at the top of the enclosure formed by the polygonal container.

38. The polygonal container of claim 27 wherein at least two polygonal cover panels and accompanying polygonal cover panel hinges are provided for overlapping disposition when said polygonal cover panels are folded into said normal disposition with respect to the corresponding rectangular side panels.

39. The polygonal container of claim 38 wherein said polygonal cover panels are attached to rectangular side panels which are separated by two intervening rectangular side panels.

40. The polygonal container of claim 37 further including at least one supplemental cover panel which is of lesser size than said polygonal cover panels and which is hingedly connected to a top edge of said rectangular side panel and foldable into normal disposition with regard to its respective rectangular side panel, whereby said polygonal cover panels are further supported in covering said enclosure opening.

* * * * *